US006023034A

United States Patent [19]

Nakajima et al.

[11] Patent Number: 6,023,034

[45] Date of Patent: Feb. 8, 2000

[54] INTER-ARTICLE GAP ADJUSTOR FOR CONTROLLED DELIVERY TO A SORTING DEVICE USING A PLURALITY OF GAP SENSORS

[75] Inventors: Kichio Nakajima; Junichi Tamamoto; Takashi Yoshida, all of Ibaraki-ken; Toshihiko Tajiri, Aichi-ken; Junji Fujita, Nagoya; Taichiro Yamashita, Tsuchiura; Kazushi Yoshida; Shunichi Oohara, both of Ibaraki-ken, all of Japan

[73] Assignee: Hitachi, Ltd., Tokyo, Japan

[21] Appl. No.: 09/190,001

[22] Filed: Nov. 12, 1998

[30] Foreign Application Priority Data

Nov. 13, 1997 [JP] Japan ..... 9-312100
Dec. 19, 1997 [JP] Japan ..... 9-350501

[51] Int. Cl.[7] ..... B07C 5/00; B65H 7/02; B65G 43/00

[52] U.S. Cl. ..... 209/584; 209/900; 209/656; 209/657; 271/258.01; 271/259; 271/176; 198/460.1; 198/460.3

[58] Field of Search ..... 209/900, 584, 209/656, 657; 271/258.01, 259, 265.01, 265.02, 176, 3.01, 3.14, 3.15, 4.01, 4.02; 198/460.1, 460.3

[56] References Cited

U.S. PATENT DOCUMENTS

| | | | |
|---|---|---|---|
| 3,251,452 | 5/1966 | Conway | 198/460.1 |
| 3,880,421 | 4/1975 | Muller | 271/259 |
| 3,889,811 | 6/1975 | Yoshimura | 209/74 |
| 4,331,328 | 5/1982 | Fasig | 271/270 |
| 4,451,027 | 5/1984 | Alper | 271/10 |
| 4,503,976 | 3/1985 | Cloud | 209/546 |
| 4,640,408 | 2/1987 | Eaves | 18/460.1 |
| 4,863,154 | 9/1989 | Hirakawa | 271/176 |
| 5,277,321 | 1/1994 | Nagasawa | 209/583 |
| 5,471,290 | 11/1995 | Nagayama | 271/259 |
| 5,860,504 | 1/1999 | Lazzarotti | 198/502.2 |
| 5,930,869 | 8/1999 | Faas | 19/98 |

*Primary Examiner*—Donald P. Walsh
*Assistant Examiner*—Daniel K Schlak
*Attorney, Agent, or Firm*—Antonelli, Terry, Stout & Kraus, LLP

[57] ABSTRACT

A paper sorting apparatus includes first to fourth gap measuring units to measure gaps between sheets of paper. Using the gaps between the sheets varying between the respective gap measuring units, target gap correction values are stored for respective sort shelves. In accordance with gaps between sheets changed between the first and second gap measuring units, there are predicted gap variations possibly taking place by when the sheets reach the associated sort shelves. Depending on the predicted gap variations, a gap adjuster is controlled to set the gaps to appropriate values at a point where the pertinent sheets reach the associated sort shelves.

24 Claims, 15 Drawing Sheets

| G1-G2 | GROUP SHELF | | | | | | | GROUP SHELF | | | | | |
|---|---|---|---|---|---|---|---|---|---|---|---|---|---|
| | 0 | 1 | 2 | 3 | 4 | 5 | | 15 | 16 | 17 | 18 | 19 | 20 |
| -6 OR LESS | 0 | 0 | 0 | 0 | 0 | 0 | | 0 | 0 | 0 | 0 | 0 | 0 |
| -5 | 0 | 0 | 0 | 0 | 0 | 0 | | 0 | 0 | 0 | 0 | 0 | 0 |
| -4 | 0 | 0 | 0 | 1 | 1 | 1 | | 3 | 3 | 3 | 4 | 4 | 4 |
| -3 | 0 | 0 | 1 | 1 | 2 | 2 | | 6 | 6 | 7 | 7 | 8 | 8 |
| -2 | 0 | 1 | 1 | 2 | 2 | 3 | | 9 | 10 | 10 | 11 | 11 | 12 |
| -1 | 0 | 1 | 2 | 2 | 3 | 4 | | 12 | 13 | 14 | 14 | 15 | 16 |
| 0 | 0 | 1 | 2 | 3 | 4 | 5 | 6 | 15 | 16 | 17 | 18 | 19 | 20 |
| 1 | 0 | 1 | 2 | 4 | 5 | 6 | 7 | 18 | 19 | 20 | 22 | 23 | 24 |
| 2 | 0 | 1 | 3 | 4 | 6 | 7 | 8 | 21 | 22 | 24 | 25 | 27 | 28 |
| 3 | 0 | 2 | 3 | 5 | 6 | 8 | 10 | 24 | 26 | 27 | 29 | 30 | 32 |
| 4 | 0 | 2 | 4 | 5 | 7 | 9 | 11 | 27 | 29 | 31 | 32 | 34 | 36 |
| 5 | 0 | 2 | 4 | 6 | 8 | 10 | 1 | 30 | 32 | 34 | 36 | 38 | 40 |
| 6 OR LESS | 0 | 2 | 4 | 6 | 8 | 10 | 1 | 30 | 32 | 34 | 36 | 38 | 40 |

INTER-ARTICLE GAP ADJUSTOR FOR CONTROLLED DELIVERY TO A SORTING DEVICE USING A PLURALITY OF GAP SENSORS

BACKGROUND OF THE INVENTION

The present invention relates to a transporting apparatus for transporting sheets of paper and articles like paper in accordance with a sorting information indicated for each of the sheets and a paper sorting apparatus for sorting sheets of paper and articles like paper in accordance with a sorting information indicated for each of the sheets.

There have been heretofore employed paper sorting apparatuses for sorting sheets of paper and articles like paper to classify postal matter in accordance with sorting informations such as postal codes, bar codes, and addresses indicated on postal items including postcards and letters.

Description will be given of such a sorting apparatus of the prior art. The apparatus includes supply means for supplying sheets of paper at a time to the apparatus. There are additionally included separating means to obtain each of the sheets from the supply means with a fixed gap between the obtained sheets, transporting means to transport the separately attained sheets, read means to read a sorting information indicated for each sheet, a plurality of sorting transporting units in which each unit opens and closes a gate for a transport path of each sheet and transports the sheet at a fixed speed, and a plurality of sort shelves arranged along the respective sorting transporting units in which the sheet is sorted into one of the shelves in accordance with classification indicated by the opening and closing of the gate.

In this configuration, while the sheet of paper from the supplying unit is being transported by the transporting unit, the sorting information on the sheet is read, and then related gates are opened and closed so that the sheet is fed via the transporting unit and the sorting transporting unit to be sorted and delivered to a sort shelf associated therewith.

In the sorting apparatus of this kind, due to thickness and materials of each sheet of paper or the like thus transported, there arises difference in friction with belts disposed in the transporting units and in smoothness of passage thereof through a transporting direction changing section. Resultantly, the gap or interval between the sheets may possibly change before the sheets are brought to the sorting transporting units or the sort shelves. Namely, there occurs mismatching between the opening and closing timing of each gate and the arrival timing of each sheet, which leads to a difficulty that the sheet of paper cannot be fed to an appropriate transporting unit and/or an appropriate sort shelf. Particularly, when the sheet gap becomes equal to or less than a predetermined value, the gates cannot be normally operated and hence there occurs a disadvantage that the sheet of paper cannot be delivered to a predetermined transporting unit and/or an appropriate sort shelf.

A sorting apparatus to solve the difficulties in the transporting of sheets of paper has been proposed, for example, by JP-B-8-018728 (JP-A-2-188344). The sorting apparatus includes a fixed-speed transporting unit for transporting sheets of paper or the like at a fixed speed, a varying speed transporting unit for transporting sheets of paper or the like at a desired speed, a gap detecting unit for detecting a gap between sheets of paper being transported by the fixed speed transporting unit, a position detecting unit for detecting a position of each sheet of paper being transported by the varying speed transporting unit, and a control section for controlling the transporting speed of the varying speed transporting unit in accordance with an output from each of the gap and position detecting units.

Detecting by the gap detecting unit the gap between the sheets of paper sequentially transported by the fixed speed transporting unit, any gap equal to or less than a predetermined value is corrected for the appropriate sorting of the sheets of paper.

SUMMARY OF THE INVENTION

In a case in which the operation to correct the gap of sheets thus sequentially transported is applied to a sorting apparatus to sort sheets of paper each being assigned with a sorting information, it should be considered the correction of the gap of sheets before the sheet reaches the entrance of the sorting transporting unit which transports the sheet to the sorting shelf.

On the other hand, however, in the above material, there has not been described any configuration unique to the paper sorting apparatus when the technology of the prior art is applied to the paper sorting apparatus of the present invention. In other words, when the transporting distance from the supply unit to an inlet point of the sorting transporting unit is substantially equal to that from the inlet point of the sort transporting means to the final sort shelf, a variation in the sheet gap taking place in an interval of time from the supply unit to the inlet point of the sorting transporting unit also appears in an interval of time from the inlet point of the sorting transporting unit to the final sort shelf. Therefore, even when a unit for correcting the sheet gap is arranged in a region preceding the inlet of the sorting transporting unit, the sheets of paper transported to the sort shelves cause the same disadvantages as for the prior art.

It is therefore an object of the present invention to provide a paper sorting apparatus for sorting sheets of paper or the like each being assigned with sorting information in which an appropriate gap is kept retained between sheets at a position of the sort shelves for the sheets, thereby improving the processing performance and reliability.

In order to achieve the object above, there is provided a paper sorting apparatus in accordance with the present invention including transporting means for transporting each of separated sheets of paper and the like, first gap measuring means for measuring a gap between sheets on an upstream side of the transporting means, second gap measuring means disposed on a downstream side of the first gap measuring means for measuring a gap between transported sheets, gap adjusting means disposed on a downstream side of the second gap measuring means for adjusting a gap between transported sheets, and control means for issuing an indication to the adjusting means in accordance with the gap measure by the first gap measuring means and the gap measure by the second gap measuring means and thereby adjusting the gaps before and after the sheet to values most suitable for the sorting of the sheets.

Additionally, the paper sorting apparatus in accordance with the present invention includes reading means disposed along the transporting means for reading sort information indicated on each sheet and sort shelves to which the sheets distributed by sort transporting means are delivered, the sort transporting means distributing transporting paths of the respective sheets. The control means adjusts, in accordance with the sort information read from the sheet, the gaps of the sheet in accordance with the sort shelf to which the sheet is to be delivered.

Furthermore, in the paper sorting apparatus in accordance, the control means adjusts, in accordance with a gap variation characteristic of the sheet on a downstream side of the adjusting means, the gaps of the sheet by the gap adjusting means in accordance with a gap variation of the sheet taking place between the first and second gap measuring means.

In addition, the control means of the paper sorting apparatus in accordance with the present invention includes gap correction values associated with the sheet gap variation characteristic on the downstream side of the adjusting means, the control means adjusting the gaps of the sheet by the gap adjusting means in accordance with the gap correction values.

Moreover, the paper sorting apparatus in accordance with the present invention includes third gap measuring means and fourth gap measuring means on a downstream side of the gap adjusting means. The control means includes gap correction values associated with the sheet gap variation characteristic associated with measured results respectively from the third and fourth gap measuring means.

Furthermore, the control means of the paper sorting apparatus in accordance with the present invention calculates a sheet gap variation characteristic of the sort transporting means in accordance with measured results from the first to fourth gap measuring means to thereby modify the gap correction values.

Additionally, in the paper sorting apparatus in accordance with the present invention, the control means calculates, when a test sheet of paper and the like is transported, the sheet gap variation characteristic.

Moreover, to achieve the object above, the paper sorting apparatus in accordance with the present invention includes transporting means for transporting each of separated sheets of paper and the like, first gap measuring means for measuring a gap between sheets on an upstream side of the transporting means, second gap measuring means disposed on a downstream side of the first gap measuring means for measuring a gap between transported sheets, gap adjusting means disposed on a downstream side of the second gap measuring means for adjusting a gap between transported sheets, control means for issuing an indication to the adjusting means in accordance with the gap measure by the first gap measuring means and the gap measure by the second gap measuring means and thereby adjusting the gaps before and after the sheet to values most suitable for the sorting of the sheets, and gate means on a downstream side of the gap adjusting means, wherein the sheets are sorted to a plurality of sort transporting means under control of the control means.

Moreover, the control means of the paper sorting apparatus in accordance with the present invention makes, when sorting a sheet, a comparison between the sheet and a sheet transported immediately before the pertinent sheet for determining whether or not the pertinent sheet and the preceding sheet are to be sorted to an identical one of the sort transporting means, and controls the gap of the pertinent sheet, when the sheet and the preceding sheet are sorted to different ones of sort transporting means, to a value enabling the gate means to sort the sheet. It may also be favorable to arrange thickness measuring means at an intermediate point of the transporting means such that a threshold value G to determine possibility and impossibility of the opening and closing operation of the gate means is changed in accordance with thickness of a sheet preceding the pertinent sheet.

In addition, the control means of the paper sorting apparatus in accordance with the present invention makes, when sorting a sheet, a comparison between the sheet and a sheet transported immediately before the pertinent sheet for determining whether or not the pertinent sheet and the preceding sheet are to be sorted to an identical one of the sort transporting means, and adjusts by the gap adjusting means the gap of the pertinent sheet in accordance with a sheet gap variation characteristic on a downstream side of the adjusting means, when the sheet and the preceding sheet are sorted to the same sort transporting means, in accordance with a sheet gap variation taking place between the first and second gap measuring means.

Furthermore, the paper sorting apparatus in accordance with the present invention includes thickness measuring means disposed at an intermediate point of the transporting means for measuring thickness of a sheet transported by the transporting means. The control means adjusts by the gap adjusting means the gap of the sheet in accordance with a sheet gap variation characteristic on a downstream side of the adjuster, a measured result from the thickness measuring means, and a sheet gap variation taking place between the first and second gap measuring means.

Additionally, the control means of the paper sorting apparatus in accordance with the present invention makes, when sorting a sheet, a comparison, when a gap adjustment is required between the pertinent sheet and a sheet transported immediately before the sheet, between the sheet and a sheet transported immediately after the pertinent sheet for determining whether or not the pertinent sheet and the succeeding sheet are to be sorted to an identical one of the sort transporting means, sets gaps with which the gate means can sort the sheet to target gaps when the sheet and the preceding sheet are sorted to different ones of sort transporting means, and thereby adjusts gaps before and after the pertinent sheet, when a gap obtained by adding a target gap for the preceding sheet and a target gap for the succeeding sheet is less than a gap obtained by adding the gaps before and after the sheet, to values satisfying the target gaps, respectively.

Moreover, the control means of the paper sorting apparatus in accordance with the present invention makes, when sorting a sheet, a comparison, when a gap adjustment is required between the pertinent sheet and a sheet transported immediately before the sheet, between the sheet and a sheet transported immediately after the pertinent sheet for determining whether or not the pertinent sheet and the succeeding sheet are to be sorted to an identical one of the sort transporting means, sets gaps with which the gate means can sort the sheet to target gaps for the pertinent sheet and the preceding sheet when the sheet and the preceding sheet are sorted to different ones of sort transporting means, adjusts, when a gap obtained by adding a target gap for the preceding sheet and a target gap for the succeeding sheet is more than a gap obtained by adding the gaps before and after the sheet, the gap between the preceding sheet and the pertinent sheet if the target gap for the preceding sheet can be ensured, and elongates, when a gap obtained by adding a target gap for the preceding sheet and a target gap for the succeeding sheet is more than a gap obtained by adding the gaps before and after the sheet, the gap between the preceding sheet and the pertinent sheet to a value not causing collision between the pertinent sheet and the succeeding sheet even if the target gap cannot be ensured.

In addition, the control means of the paper sorting apparatus in accordance with the present invention makes, when sorting a sheet, a comparison, when a gap adjustment is required between the pertinent sheet and a sheet transported immediately before the sheet, between the sheet and a sheet transported immediately after the pertinent sheet for determining whether or not the pertinent sheet and the succeeding sheet are to be sorted to an identical one of the sort transporting means, sets as target gaps, when the pertinent sheet and the succeeding sheet are to be sorted to an identical one of the sort transporting means, gaps obtained in accordance with a sheet gap variation characteristic on a downstream side of the adjusting means and in accordance with a sheet gap variation between the pertinent sheet and the succeeding sheet taking place between the first and second gap measuring means, and adjusts the gaps before and after the pertinent sheet to values satisfying the target gaps when a gap obtained by adding a target gap for the preceding sheet and a target gap for the succeeding sheet is less than a gap obtained by adding the gaps before and after the sheet.

Furthermore, the control means of the paper sorting apparatus in accordance with the present invention makes, when sorting a sheet, a comparison, when a gap adjustment is required between the pertinent sheet and a sheet transported immediately before the sheet, between the sheet and a sheet transported immediately after the pertinent sheet for determining whether or not the pertinent sheet and the preceding sheet are to be sorted to an identical one of the sort transporting means, sets as target gaps, when the pertinent sheet and the preceding sheet are to be sorted to an identical one of the sort transporting means, the gaps obtained in accordance with a sheet gap variation characteristic on a downstream side of the adjusting means and in accordance with a sheet gap variation between the pertinent sheet and the succeeding sheet taking place between the first and second gap measuring means, adjusts, when a gap obtained by adding a target gap for the preceding sheet and a target gap for the succeeding sheet is more than a gap obtained by adding the gaps before and after the sheet, the gap between the preceding sheet and the pertinent sheet if the target gap for the preceding sheet can be ensured, and elongates, when a gap obtained by adding a target gap for the preceding sheet and a target gap for the succeeding sheet is more than a gap obtained by adding the gaps before and after the sheet, the gap between the preceding sheet and the pertinent sheet to a gap not causing collision between the pertinent sheet and the succeeding sheet even if the target gap cannot be ensured.

Additionally, in the paper sorting apparatus in accordance with the present invention, an appropriate gap between sheets successively transported for distribution thereof to different ones of the sort transporting means is less than an appropriate gap therebetween for distribution thereof to an identical one of the sort transporting means.

Moreover, in the paper sorting apparatus in accordance with the present invention, the gap adjusting means includes a roller disposed to be brought into contact with a transporting path of sheets transported by the transporting means, a pinch roller disposed to be brought into contact with and to be releasable from the roller with the transporting path therebetween, and variable-speed driving means for driving a rotary movement of the rollers.

Additionally, in the paper sorting apparatus in accordance with the present invention, the gap adjusting means alternatively includes a roller disposed to be brought into contact with a transporting path of sheets transported by the transporting means, variable-speed driving means for driving a rotary movement of the roller, a belt conveyer disposed to be brought into contact with the roller with the transporting path therebetween, and variable-speed driving means for driving the belt conveyer.

Furthermore, in the paper sorting apparatus in accordance with the present invention, the gap adjusting means alternatively includes a plurality of series-connected sets of components along a direction of transportation, each set of components including a roller disposed to be brought into contact with a transporting path of sheets transported by the transporting means, variable-speed driving means for driving a rotary movement of the roller, a belt conveyer disposed to be brought into contact with the roller with the transporting path therebetween, and variable-speed driving means for driving the belt conveyer.

Additionally, in the paper sorting apparatus in accordance with the present invention, the gap adjusting means alternatively includes a roller disposed to be brought into contact with a transporting path of sheets transported by the transporting means, the roller having a high coefficient of friction with respect to a sheet of paper, variable-speed driving means for driving a rotary movement of the roller, a belt conveyer disposed to be brought into contact with the roller with the transporting path therebetween, the belt conveyer having a low coefficient of friction with respect to the sheet of paper, and driving means for driving the belt conveyer at the fixed speed.

Moreover, in the paper sorting apparatus in accordance with the present invention, the gap adjusting means alternatively includes distance changing means for changing a transporting distance from an exit on an upstream side of the transporting means to an entrance on a downstream side thereof. The distance changing means may include a plate-shaped gate member capable of conducting a swinging movement, the distance changing means changing by the swinging of the gate member a transporting distance from an exit on an upstream side of the transporting means to an entrance on a downstream side thereof. Alternatively, the distance changing means may include a swing arm having an end capable of conducting a swinging movement in a reciprocal manner to approach and to apart from an entrance on a downstream of the transporting means, a roller rotatably supported onto an end of the swing art, and a belt conveyer on an upstream side of the transporting means, the belt conveyer being installed on the roller for a rotary action of the roller.

In the paper sorting apparatus of the present invention in the configuration above, there are included first gap measuring means for measuring a gap between sheets of paper separated by the separating means, second gap measuring means for measuring a gap between sheets of paper delivered to the gap adjusting means, and gap control means for controlling the gap adjusting means. In accordance with a transporting distance from the first gap measuring means to the second gap measuring means, a gap of sheets measuring by the first gap measuring means, and a gap of sheets measuring by the second gap measuring means, there is predicted a gap between sheets when the sheet of paper arrives at the sort transporting means or the sort shelves to thereby adjust the gap.

Additionally, the paper sheet transporting apparatus in accordance with the present invention includes transporting means for transporting a plurality of sheets of paper and the like, gap measuring means for measuring a gap between sheets of paper transported by the transporting means, and gap adjusting means for adjusting a gap of sheets consecutively transported. The apparatus includes a plurality of gap measuring means such that in accordance with a change in the gap between sheets measured by each gap measuring means and distance between the respective measuring means, the gap adjusting means adjust the gap to an appropriate value when the gap arrives at the destination of the transportation.

Still further advantages of the present invention will become apparent to those of ordinarily skill in the art upon reading and understanding the following detailed description of the preferred and alternate embodiments.

BRIEF DESCRIPTION OF THE DRAWINGS

The invention will be described in conjunction with certain drawings which are for the purpose of illustration of the preferred and alternate embodiments of the invention only, and not for the purposes of limiting the same, and wherein.

DESCRIPTION OF THE PREFERRED EMBODIMENTS

Figure 1:
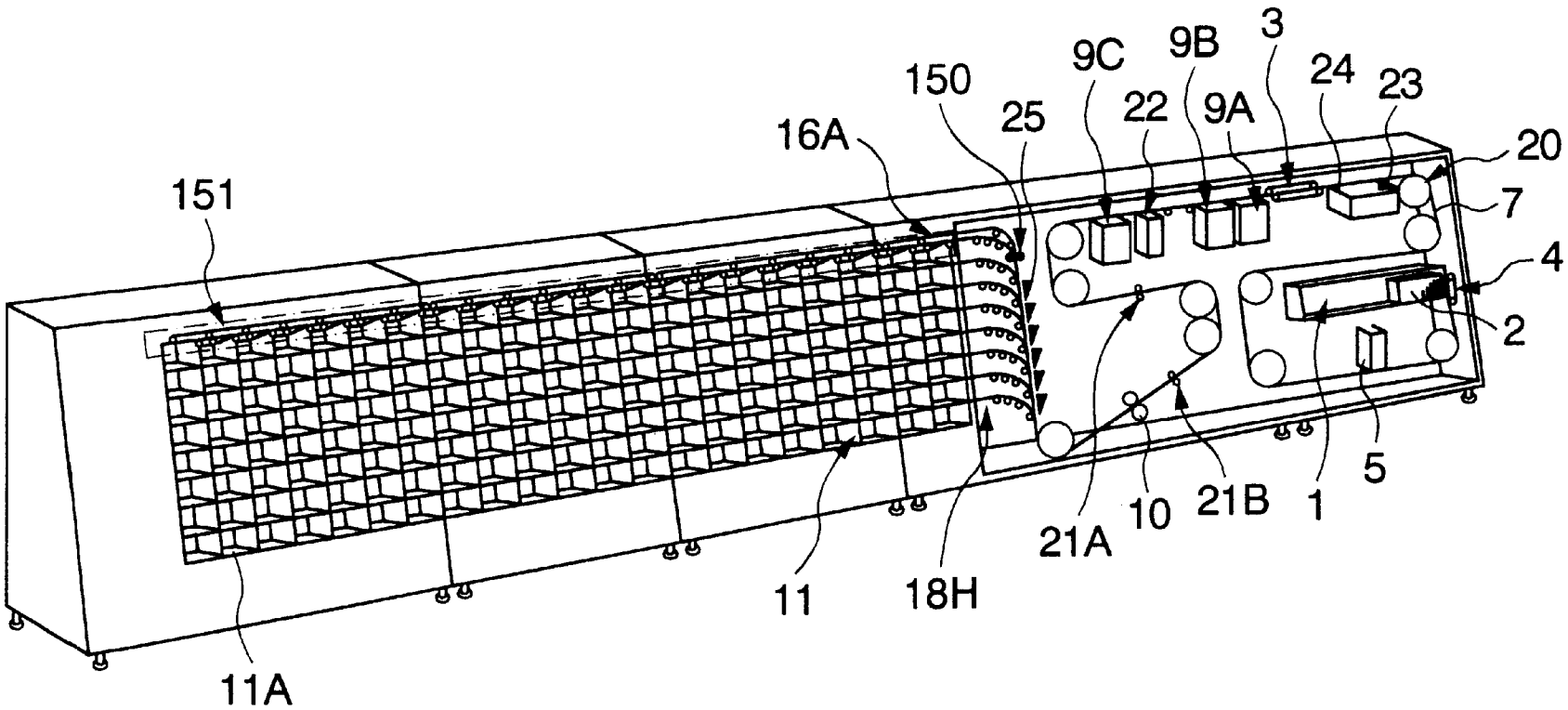
FIG. 1 is a perspective view of an embodiment of a paper sorting apparatus in accordance with the present invention.

Referring now to the drawings, description will be given of an embodiment of a paper sorting apparatus for use with a postal matter sorting machine in accordance with the present invention.

FIG. 1 shows in a perspective view a paper sorting apparatus to which the present invention is applied. The apparatus of FIG. 1 will be next described.

In a supply unit 1, there are temporarily stored a plurality of sheets of paper 2 such as postal matter including postcards and letters. A separator unit 4 separates the sheets 2 at an exit point of the supply unit 1. Specifically, for this purpose, the unit 4 includes a vacuum absorbing belt to fix each sheet 2 thereonto by vacuum and then the belt is traveled by a motor, not shown. The sheets 2 stored in the supply unit 1 is accordingly separated by the separator 4 so that each sheet is separately delivered to a transporter unit 7. The transporter 7 is a unit to convey the sheets 2 from the separator 4 to a section path gate 25, which will be described later. The separator 4 separates the sheets 2 to feed the separated sheets 2 to the transporter 7 such that there exists between the separated sheets 2 a minimum separation gap which is obtained by adding a minimum gap between the sheets 2 necessary for the separation thereof in the sort shelf 11 to a variation in the gap taking place during the transportation of the sheets 2.

The transporter 7 includes a plurality of belts to transport the sheets 2 separated by the separator 4 and a plurality of pulleys 20 arranged at predetermined positions. The belts are installed appropriately on the pulleys to convey the sheets 2 at desired positions thereof. Each belt includes two sub-belts to retain each sheet 2 therebetween. The belts are driven to travel at a fixed speed under control of the system.

A detector unit 5 carries out a plurality of detecting or sensing operations. Namely, the unit 5 detects a duplicated state of sheets 2 delivered by the transporter 7 (in which a plurality of sheets 2 are overlapped with each other), flexural rigidity (stiffness) of sheets 2, thickness thereof, etc.

Along the transporter 7 is disposed a transport gate 23 to change a transport path of each sheet 2. In response to a signal from the detector 5, any sheet 2 which is in the duplicated state or which exceeds a predetermined value is rejected through opening and closing of the gate 23 and is recalled into a reject box 24. The gate 23 may be controlled in accordance with a detection signal from the detector 5 to be opened or closed at transportation timing of the sheet 2, for example, when a predetermined period of time lapses thereafter.

A leveler unit 3 restores a skewed portion of the sheet 2 or a shift thereof to an appropriate condition so that a sorting information indicated on the sheet 2 is fed by the transporter 7 through a predetermined path.

An address reader unit 9*a* reads a postal code and an address on the sheet 2. A bar code reader unit 9*b* reads a bar code on the sheet 2. In accordance with information obtained by the address reader 9*a*, an ink jet printer 22 prints a bar code on any sheet 2 on which a bar code is missing. The printer 22 is favorably disposed at a position in consideration of a period of time to analyze the postal code and the address attained by the address reader 9*a*. A bar code reader unit 9*c* reads the bar code printed by the ink jet printer 22. Information thus obtained is stored as sort information in a sort information input unit 73.

The sheet 2 separated by the separator 4 passes through a first gap sensor 21A. The sensor 21A includes, for example, a photoelectric sensor including a light emitter and a light receiver respectively arranged on the opposite sides of the transport path of the sheet 2. In this configuration, the sensor 21A transmits an on or off signal in accordance with a state of passage of the sheet 2 on an optical axis of the photoelectric sensor. The sensor 21A is arranged at an upstream position of the transport path relative to a second gap sensor 21B, which will be described later.

When the first gap sensor 21A is disposed at an upstream position of the transport gate 23 and the reject box 24, any sheet 2 transported with an unacceptable gap can be rejected into the box 24 in response to an output signal from the sensor 21A. In an abnormality, for example, when two sheets are fixed to each other, the sheet 2 is possibly fed from the separator 4 to the transporter 7 with a sheet gap less than the minimum separation gap. When the gap for the transportation of sheets 2 becomes less than the minimum gap required for the operations in a sort path gate and a sort shelf 11, which will be described later, there may occur a case in which the proceeding sheet 2 collides with the succeeding sheet 2. In this situation, the gap cannot be corrected. In consequence, it is advantageous to eject the sheet 2 delivered with a gap less than the minimum gap into the reject box 24.

The sensor 21B includes, for example, a photoelectric sensor including a light emitter and a light receiver to sandwich the transport path of the sheet 2 therebetween. In this structure, the sensor 21B produces an on or off signal in accordance with a state of passage of the sheet 2 on an optical axis of the photoelectric sensor. The second gap sensor 21B is arranged at an upstream position of the transport path relative to a gap adjuster unit 10, which will be described later.

Figure 2:
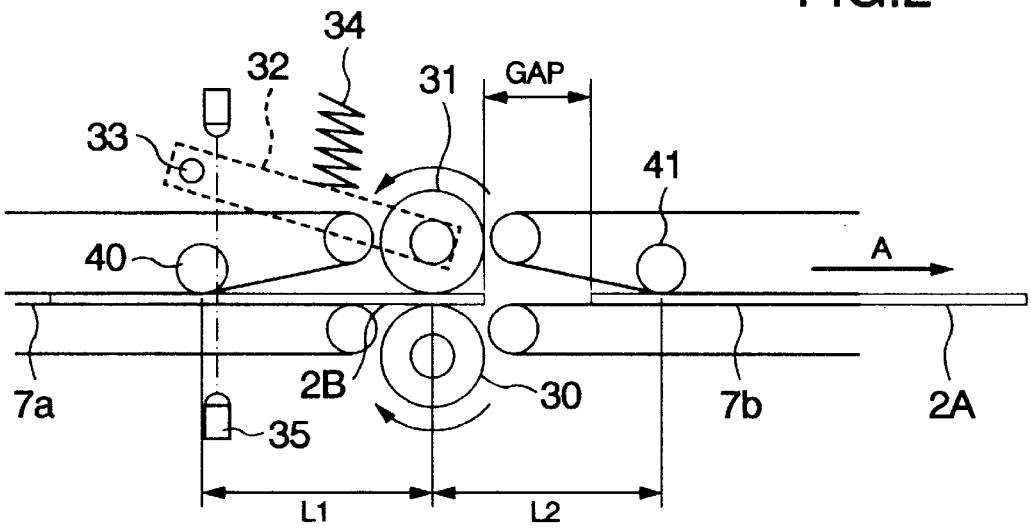
FIG. 2 is a diagram showing constitution of an gap adjusting unit in accordance with the present invention.

The gap adjuster 10 is constructed, for example, to adjust a gap between the sheets 2 in the transporter 7 in accordance with the present invention as shown in FIG. 2.

The section path gate 25 is disposed at a downstream position of the transporter 7 in association with a sort transporter unit 16. The sort transporter 16 transports the sheet 2 distributed in accordance with the opening and closing of the path gate 25. An end point in the downstream region of the gate 25 is coupled with a sort transporter unit 16A on the transportation path of the sheets 2. Along each of the sort transporter units 16A to 16H, there are disposed a plurality of sort shelves 11 (the sort transporters 16B to 16G are substantially equal to the sort transporters 16A and 16B already shown and hence are not particularly indicated in the drawings). The reject sort shelves 11A are arranged in the lower-most position on the downstream side of the sort transporter 16.

A third gap sensor 150 is disposed immediately after the path gate 25. In the sort transporter 16, a fourth gap sensor 151 is arranged immediately before a sort shelf (with shelf number 20) in a lower-most position on the downstream side of the sort transporter 16. The third and fourth gap sensors 150 and 151 will be described later.

The operation in which sheets 2 transported by a desired sort transporter 16 are collected in a column of sort shelves 11 including an objective sort shelf 11 will be described in detail later by referring to FIG. 6.

FIG. 2 shows the configuration of the gap adjuster 10 in accordance with the present invention. A roller 30 is arranged between an upstream belt 7*a* and a downstream belt 7*b* which are constituent elements of the transporter 7. The roller 30 is driven by a servomotor, not shown. A pinch roller 31 has an end rotatably is supported by a swing arm 32 which is supported by a shaft 33 for a swinging movement thereof. The pinch roller 31 is pushed against the roller 30 by a predetermined force. A sheet sensor 35 detects a sheet 2 fed to the gap adjuster 10 as well as an event that the sheet 2 held by a transporter unit 7*a* on the upstream side in the transportation direction is released from the pinched state.

Assume that the distance between where the sheet 2 is released from the state pinched by the belt 7*a* and where the sheet 2 is held between the rollers 30 and 31 is indicated as L1, the distance between where the sheet 2 is released from the state pinched by the rollers 30 and 31 and where the sheet 2 is pinched by the belt 7*b* is denoted as L2, and the minimum dimension or length of the sheet 2 handled by the paper sorting apparatus is represented as Lmin. When the roller 30 is set to a position to satisfy Lmin>L1 and Lmin>L2, the sheet 2 transported is continuously held by the belt 7*a*, a combination of rollers 30 and 31, and the belt 7*b*, which leads to a stable transportation of the sheet 2.

Description will now be given of the principle of the adjusting of the gap between sheets 2 in the gap adjuster 10.

After a preceding sheet 2 is passed therethrough, the adjuster 10 changes the rotary speed of the roller 30 in response to an instruction supplied from a control unit, which will be described later. The change in the rotary speed of the roller 30 varies the feeding speed of a succeeding sheet 2 and hence the gap between these sheets 2*a* and 2*b* is adjusted as shown in FIG. 3.

Figure 3:
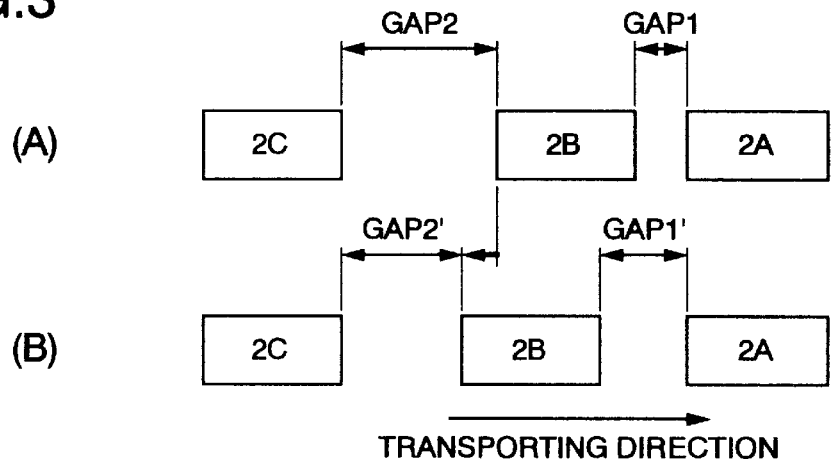
FIG. 3 is a schematic diagram showing a state of adjusting sheet gaps.

FIG. 3 shows in a schematic diagram a gap adjusting state of sheets of paper transported. As shown in (A) of FIG. 3, when the gap between sheets 2*a* and 2*b* becomes GAP1 which is less than the minimum gap necessary for the distribution and the gap between sheets 2*b* and 2*c* is GAP2 in the transportation, the feeding speed of sheet 2*b* is lowered to elongate the gap between the sheets 2*a* and 2*b* to GAP1' exceeding the minimum gap as shown in (B) of FIG. 3. On this occasion, the gap between the sheets 2*b* and 2*c* is reduced to GAP2'.

When the gap GAP2' between the sheets 2*b* and 2*c* becomes less than the minimum gap, the feed speed of the sheet 2*c* is decreased to keep an appropriate gap with respect to the sheet 2*b*. Moreover, under a condition that the gap GAP1' after the adjustment is less than the minimum gap, even when the gap correction repeatedly conducted, there does not occur a case in which the gap for the succeeding sheet is gradually decreased to finally make it impossible to conduct the correction.

Figure 4:
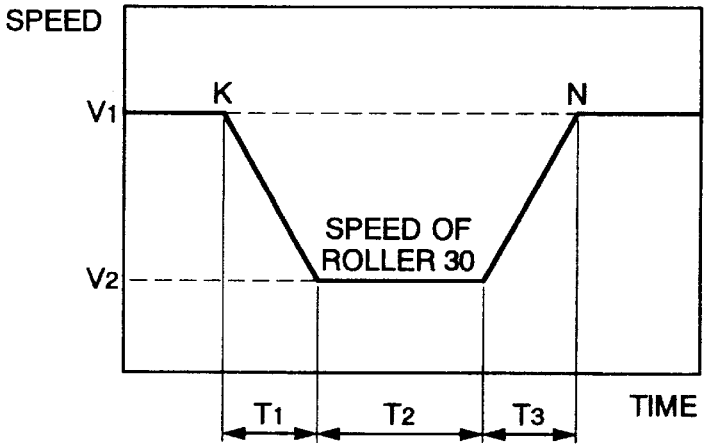
FIG. 4 is a graph showing a characteristic related to an gap adjusting state with respect to a sheet transporting speed.

FIG. 4 shows in a characteristic graph the gap adjusting state in association with the sheet transporting speed. Assume, for example, that the transporting speed of sheet by the belts 7*a* and 7*b* is denoted as V1, the peripheral speed of the roller 30 is V2, a period of time from when the transporting speed of the sheet 2 delivered by the belt 7*a* changes from V1 to V2 is designated as t1, a period of time in which the sheet 2 is fed by the roller 30 is represented as t2, and a period of time in which the speed of the sheet 2 fed by the roller 30 is increased by the belt 7*b* to a transporting speed of V1 is indicated as t3 as shown in FIG. 4.

When the peripheral speed of the roller 30 is set to the transporting speed V1 of the belts 7*a* and 7*b*, the sheet 2*b* travels a distance of K as follows.

$$K=(t1+t2+t3)V1$$

Assuming now t1=t3, K=(2t1+t2)V1 results.

On the other hand, when the peripheral speed of the roller 30 is reduced, the sheet 2*b* travels a distance of k as follows.

$$k=t1(V1+V2)/2+t2\cdot V2+t3(V1+V2)/2.$$

Assuming t1=t3, k=t1×V1+t1×V2+t2×V2 results.

In consequence, the gap variation G is obtained as G=K−k=(t1+t2+t3)V1−(t1×V1+t1×V2+t2×V2)=(t1+t2)×(V1−V2).

Incidentally, when the preceding and succeeding sheets 2*a* and 2*b* pass the same sort transporter 16, the gap between the sheets 2 is calculated to be adjusted in accordance with the distance between the succeeding sheet 2*b* and a sort shelf 11 in which the sheet 2*b* is to be delivered. On the other hand, when the preceding and succeeding sheets 2*a* and 2*b* pass mutually different sort transporters 16, the gap between the sheets 2 is calculated to be adjusted in accordance with the distance between the succeeding sheet 2*b* and a section path gate 25 through which the sheet 2*b* is to be fed.

Figure 5:
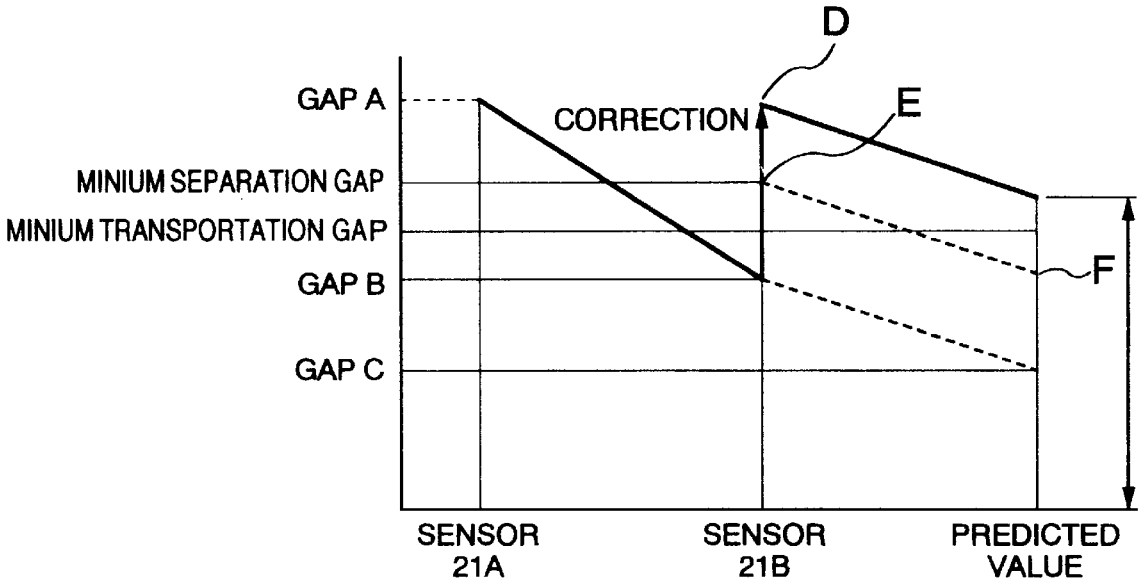
FIG. 5 is a graph showing a characteristic of change in the sheet gap.

FIG. 5 shows in a characteristic graph the change in the gap between the sheets 2. As can be seen from FIG. 5, when gap a measured by the first gap sensor 21A is different from gap b detected by the second gap sensor 21B, there is predicted in accordance with a state of the transportation path thereafter a change in the gap possibly occurring before the path gate 25 or the sort shelf 11. Using the predicted value, the gap is set to a value of d so that there can obtained at the arrival at the gate 25 or the shelf 11 a gap of f larger than the minimum gap necessary for the distribution.

In this connection, the gap is ordinarily required to be adjusted only between the minimum gap for the distribution and the minimum separation gap e. Therefore, in a case in which the gap is required to be set to d exceeding the minimum separation gap e as described above, there may occur collision between the preceding and succeeding sheets. Consequently, the succeeding sheet 2*b* is passed through a path gate 25 of the preceding sheet 2*a* and then is delivered to a reject sort shelf 11A.

Figure 6:
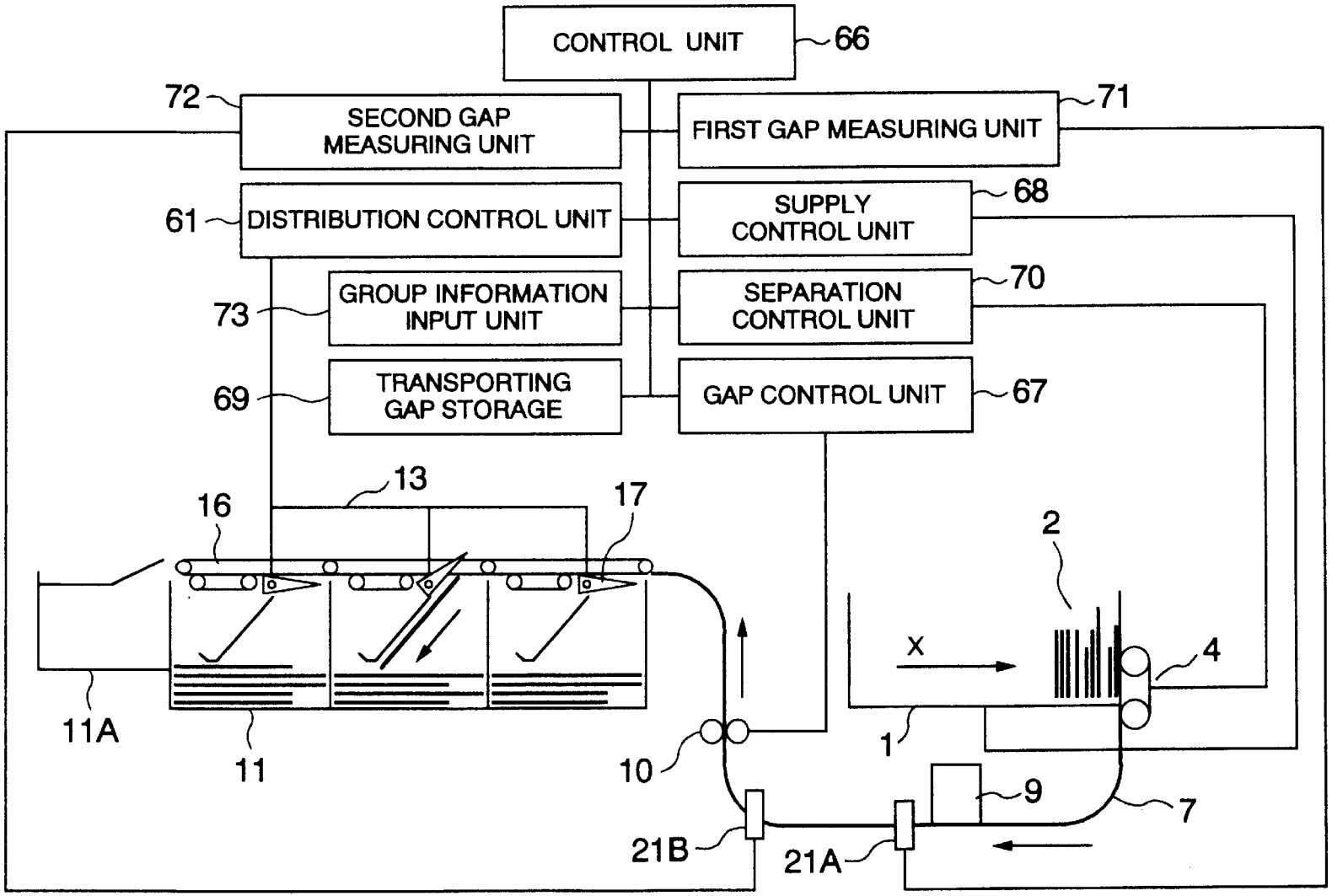
FIG. 6 is a diagram of a control system for explaining a first control method of the paper sorting apparatus in accordance with the present invention.

FIG. 6 shows in a control system diagram a first control method of the paper sorting apparatus in accordance with the present invention. Referring to FIG. 6, description will be given of a control operation in which sheets 2 are transported from the supply unit 1 to the sort shelves 11 for the sorting of the sheets 2.

A supply control unit 68 controls operation such that a first sheet 2 of the supply unit 1 is located at a predetermined position. The sheet 2 is controlled to be appropriately fed in a direction of an arrow X. A separation control unit 70 supervises the separator 4 to control the gap between the sheets 2 to the transporter 7.

A first gap measuring unit 71 measures in accordance with the on or off signal from the gap sensor 21A the gap between two sheets 2 consecutively transported. A second gap measuring unit 72 measures in accordance with the on or off signal from the gap sensor 21B the gap between two sheets 2 consecutively transported. Although not shown in FIG. 6, the measuring method related to the first and second gap sensors 21A and 21B also applies to third and fourth gap sensors 150 and 151.

A gap storage 69 is used to store therein and to read therefrom the measurement results of the first and second gap measuring units 71 and 72. A sort information input unit is disposed to store therein and to read therefrom sort information of the sheet 2 read by the reader 9 (the address reader 9*a*, the bar code reader 9*b*, or the bar code reader 9*c*).

A gap control unit 67 supervises the gap adjusting unit 10 to control the gap between the sheets 2 successively transported. A distribution control unit 61 controls the opening and closing of a section gate 17 corresponding to the section path gate 25 (reference is to be made to FIG. 1) and the sort shelf 11 to thereby distribute each sheet 2.

A control unit 66 controls the supply control unit 68, the separation control unit, the first gap measuring unit 71, the second gap measuring unit 72, the gap storage 69, the sort information input unit 73, the distribution control unit 61, and the gap control unit 67. The controller 66 moreover executes various kinds of processing. When employing the third and fourth gap sensors 150 and 151, there are disposed third and fourth gap measuring units in association therewith such that the operation is conducted under control of the controller 66.

Description will be given in detail of the control operation for the transportation and the sorting of the sheets 2.

When a sheet 2 fed by the transporter 7 is detected by the first gap sensor 21A, the sensor 21A produces an off signal therefrom. When the sheet 2 passes through the sensor 21A, the sensor 21A outputs an on signal.

When the preceding sheet 2A passes through the sensor 21A and an on signal is outputted from the sensor 21A, the first gap measuring unit 71 starts measuring time. When the succeeding sheet 2B is detected by the sensor 21A and an off signal is outputted from the sensor 21A, the first gap measuring unit 71 terminates the time measuring operation and then sends a period of time thus obtained to the gap storage 69.

When the preceding sheet 2 fed by the transporter 7 is detected by the second gap sensor 21B, the sensor 21B produces an off signal therefrom. When the sheet 2 passes through the sensor 21B, the sensor 21A outputs an on signal.

When the preceding sheet 2A passes through the sensor 21B and an on signal is outputted from the sensor 21B, the second gap measuring unit 72 commences measuring time. When the succeeding sheet 2B is detected by the sensor 21B and an off signal is outputted from the sensor 21B, the second gap measuring unit 72 terminates the time measuring operation and then sends a period of time resultantly obtained to the gap storage 69.

When the sheet 2B reaches the gap adjuster 10, the controller 66 calculates a gap adjusting quantity in accordance with the gaps respectively between the sheets 2A and 2B and between the sheets 2B and 2C which are measured by the first and second gap measuring units 71 and 72 and which are stored in the gap storage 69 and the sort destinations of the sheet 2B and its preceding and sheets 2A and 2C. The controller 66 then delivers a resultant value of gap adjusting quantity to the gap controller 67. In this connection, the method of calculating the gap adjusting quantity will be described later.

Figure 7:
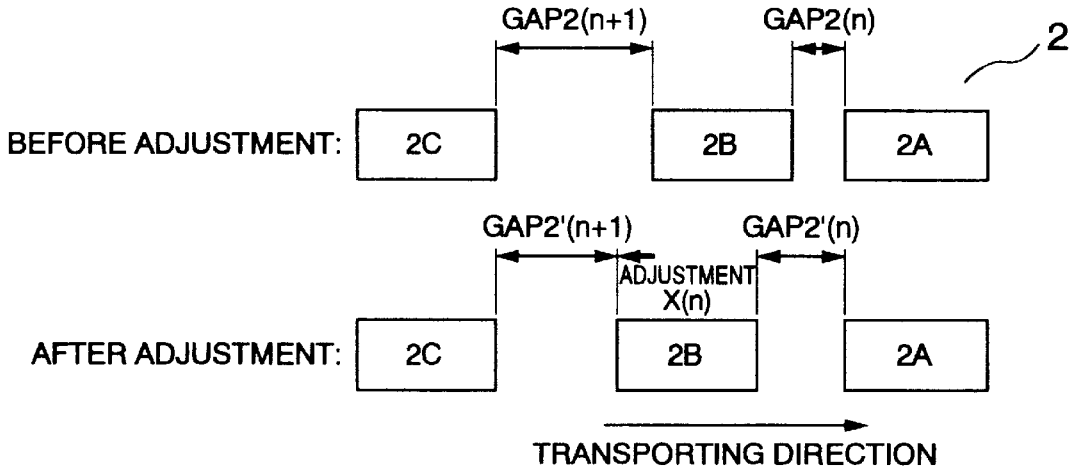
FIG. 7 is a schematic diagram showing a sheet gap adjusting state.

The gap controller 67 changes, after the preceding sheet 2A passes through the roller 30, the rotating speed of the roller in response to an instruction issued from the controller 66 as shown in FIG. 2. By altering the rotary speed of the roller 30, the gap controller 67 varies the feeding speed of the subsequent sheet 2B. For example, the gap between the sheets 2A and 2B is changed from Gap2(n) to Gap2'(n) as shown in FIG. 7.

The sheets 2 for which the gap is adjusted by the gap adjuster 10 are delivered to the section path gates 25. The distribution controller 61 opens or closes the gates 25 at timing when the sheets 2 fed from the gap adjuster 10 arrives at an associated gate 25 to thereby distribute the sheets 2 to related sorting transporting units 16A to 16H.

Additionally, the distribution controller 61 controls in accordance with the sort information indicated on each sheet 2 the opening or closing operation of an associated sort gate 17 of the sort transporter 16. The sort gate 17 is arranged for each sort shelf 11. The sheet 2 is delivered through the opening or closing operation of the sort gate 17 from the sort transporter 16 to the sort shelf 11. Any sheet 2 which cannot be fed to the sort shelf for some reasons is fed to the reject shelf 11A.

Subsequently, referring to FIGS. 7 and 8, description will be given in detail the method of calculating the gap adjusting quantity in accordance with the preceding and succeeding gaps of the sheets 2 which are measured by the first and second gap measuring units 71 and 72 and which are stored in the gap storage 69 and the sort destinations of the preceding and succeeding sheets 2.

FIG. 7 shows a gap adjusting state of sheets 2. Before the gap adjustment as shown in the upper, the gap between the sheets 2A and 2B is Gap2(n) and that between the sheets 2B and 2C is Gap2(n+1). After the gaps are adjusted as shown in the lower side, the gap between the sheets 2A and 2B is Gap2'(n) and that between the sheets 2B and 2C is Gap2'(n+1). In FIG. 7, the preceding and succeeding gaps of the sheet 2B are adjusted. Namely, the sheet 2B is moved backward by a distance of X(n) in the transporting direction.

In other words, as can be seen in the state before adjustment, when the gap between the sheets 2*a* and 2*b* is GAP1 less than the minimum distribution gap and the gap between the sheets 2*b* and 2*c* is Gap2 in the transportation, the feeding speed of the sheet 2B is lowered. Namely, as shown in the state after adjustment, the gap between the sheets 2*a* and 2*b* is adjusted to GAP1' exceeding the minimum distribution gap. As a result, the gap between the sheets 2*b* and 2*c* are reduced to GAP2'.

When the gap GAP2' between the sheets 2*b* and 2*c* becomes less than the minimum distribution gap, the feeding speed of the sheet 2*c* is decreased to appropriately adjust the gap between the sheets 2*c* and 2*b*. In this regard, if the adjusted gap GAP1' is less than the minimum separation gap, even when the gap correction is repeatedly conducted, there does not occur a case of impossibility of the correction due to reduction in the gap with respect the succeeding sheet.

Figure 8:
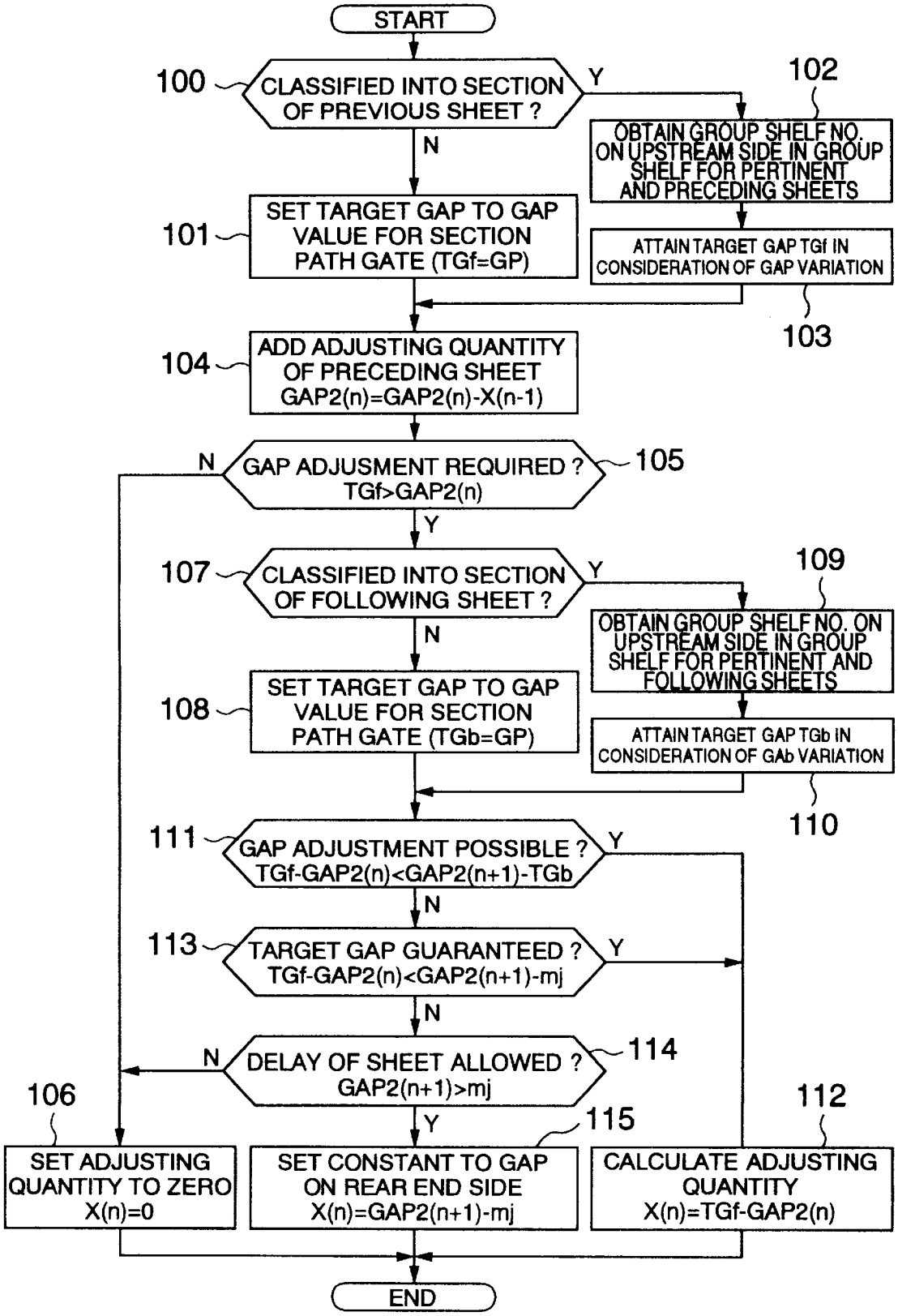
FIG. 8 is a flowchart of calculating a gap adjusting quantity in the first control method in accordance with the present invention.

FIG. 8 shows a flowchart of calculating the gap adjusting quantity in the first control method of the present invention.

When the sheet 2B arrives at the gap adjuster 10, a check is made in step 100 to determine in accordance with the sort information stored in the sort information input unit 73 whether or not the sheet 2B for the gap adjustment belongs to sort shelves related to in the sort transporter 16 associated with the preceding sheet 2A. If the sheet 2B is to be classified into a sort shelf related to another sort transporter 16, control is passed to step 101 in which a target gap TGf between the sheet 2A and 2B is set to a section path gate target gap GP. After the sheet 2B passes the gate 25, there is ensured a gap equal to or more than one sheet 2 and hence it is necessary to consider a gap fluctuation in the sort transporters 16 located at downstream positions relative to the gate 25. Therefore, the target value GP is set to a setting value with a slight margin for the gap necessary for the distribution of the sheets 2A and 2B by the gates 25.

When it is determined that the sheet 2B belongs to a sort shelf related to the sort transporter 16 of the preceding sheet 2A, control is transferred to step 102 to select sort shelf numbers (sequentially assigned as 0 to 20 beginning at the upper-most shelf on the upstream side) on the upstream side of the transportation path in the sort shelves associated with the sheets 2A and 2B for the following reasons. Namely, if the sort shelf for the sheet 2A is on the upstream side of the sort shelf of the sheet 2B, when the sheet 2A is installed into the sort shelf, there is ensured a gap equal to at least one sheet 2 for the gap GAP2 for the sheet 2B. Additionally, if the sort shelf for the sheet 2B is on the upstream side of the sort shelf of the sheet 2A, when the sheet 2A is installed into the sort shelf, there is naturally required only to ensure a gap to deliver the sheet 2B in the sort shelf.

Thereafter, control is passed to step 103 to obtain the target gap TGf between the sheets 2A and 2B in consideration of the gap variation taking place in the sort transporter 16.

Next, a method of calculating the target gap TGf will be described by referring to FIGS. 1, 9, and 10.

Figures 9, 10:
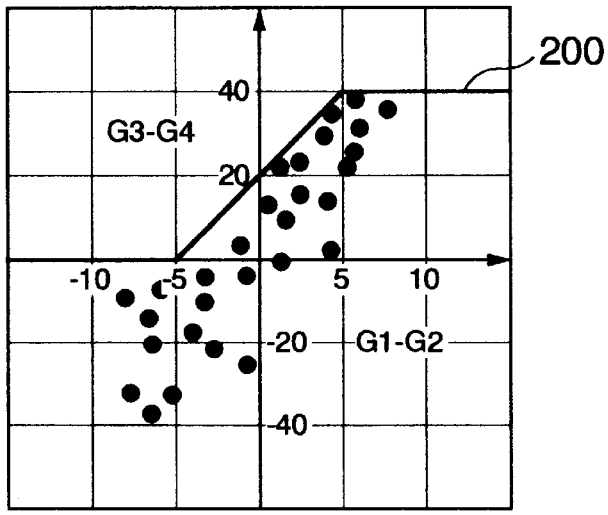
FIG. 9 is a graph showing a characteristic of a gap variation in a range from the upper-most upstream point to the lower-most downstream point of a sorting transporting unit 16.
FIG. 10 is a diagram showing an example of a relationship between sort shelf numbers and target gap correction values.

FIG. 9 shows in a graph a characteristic of the gap fluctuation taking place in a range from the upper-most position on upstream side to the lower-most position on the downstream side of the sort transporter 16. FIG. 10 shows an example of a relationship between sort shelf numbers and target gap correction values. In this case, a target gap correction value is a value determined in a method, which will be described later and indicates a reduction taking place in a period of time up to a target sort shelf in the gap already reduced between the first and second gap sensors, i.e., in the difference G1–G2 between the gap G1 measured by the first gap sensor 21A and the gap G2 obtained by the second gap sensor 21B.

To obtain the target gap TGf between the sheets in consideration of the gap variation taking place up to the objective sort shelf in the sort transporter 16, it is required first obtain a characteristic of the gap variation occurring in a range from the upper-most position on the upstream side to the lower-most position on the downstream side in the sort transporter 16. FIG. 9 shows an example of the characteristic of the gap variation occurring in a range from the upper-most position on the upstream side to the lower-most position on the downstream side in the sort transporter 16. The characteristic of FIG. 9 is obtained as follows.

A large number of sheets of paper 2 which are made of mutually different materials and which have mutually different thicknesses are separated through the separator 4 such that each of the sheets 2 is delivered to an associated sort shelf (with shelf no. 20) at a downstream position of the fourth gap sensor 151. Thereafter, the gaps between the respective sheets are measured by the first to fourth gap sensors 21A, 21B, 150, and 151, the first and second gap measuring units 71 and 72, and fourth and third gap measuring units, now shown. In the graph of, the different (G1–G2) between a sheet gap value G1 measured by the first gap sensor 21A and a sheet gap G2 attained by the first gap sensor 21B and the different (G3–G4) between a sheet gap value G3 obtained by the third gap sensor 150 and a sheet gap G4 measured by the fourth gap sensor 151 are assigned respectively to the abscissa and the ordinate of the graph in which each associated points are indicated by a solid dot.

In most cases, for the sheets of which the gap becomes smaller, i.e., (G1–G2) is positive, between the first and second sensors 21A and 21B, the gap is much more reduced, i.e., (G3–G4) is positive, between the third and fourth sensors 150 and 151. However, the proportional relationship in change is not fixed therebetween, namely, even when G1–G2 is a small value, G3–G4 may take a large value. Therefore, if the value of G3–G4 is predicted by multiplying a fixed value by the detected value for G1–G2 to obtain a target gap between sheets by using the predicted value as the gap variation in the sort transporter 16, the gap becomes excessively narrowed during the transportation by the sort transporter 16 and hence the sort gates 17 cannot be appropriately opened or closed, which makes it impossible to store each transported sheet 2 in the associated sort shelf 11.

To cope with the difficulty in accordance with the present invention, the gap variation in the gap transporter 16 is predicted in accordance with a broken line 200 which covers almost all of data items indicated by solid circles in FIG. 9. Since there occurs no problem for the increase in the sheet gap, the broken line 200 takes a value equal to or more than 0 along the ordinate. The value of G1–G2 is detected under this condition. The gap variation in the sort transporter 16 is then detected by multiplying a fixed value by the detected value, thereby removing the problem above.

Additionally, the data of FIG. 9 shows the gap variation in a range from the upper-most position on the upstream side to the lower-most position on the downstream side of the sort transporter 16. However, as described above, there is only necessary to ensure a gap which enable each sheet 2 to be stored in an associated sort shelf. Therefore, in accordance with the present invention, using the broken line 200, there are stored in the control unit 66 target gap correction values corresponding to the difference G1–G2 between the first and second gap sensors 21A and 21B and the sort shelf numbers as shown in FIG. 10.

Namely, a target gap correction value is attained in step 103 in accordance with the difference (Gap2(n) of FIG. 4) between the gap G1 of sheet 2 measured by the first gap measuring unit 71 and the gap G2 of sheet 2 obtained by the second gap measuring unit 72 and a sort shelf number attained in step 102, the gaps G1 and G2 being stored in the gap storage 69. For example, when the value of G1–G2 is two millimeters (mm) and the sort shelf number is 16, the target gap correction value is obtained as 22 mm. Adding thereto a gap vale Gr required for the opening or closing of the sort gate 17, there is attained the target gap value TGf. It will be more favorable to determine the gap value Gr for the opening or closing of the gate 17 in consideration of the gap variation in a range from the gap adjuster 10 to the gap shelf 0.

Thereafter, control is transferred to step 104 in FIG. 8 such that a gap adjusting quantity X(n−1) of the preceding sheet 2A is subtracted from the gap Gap2(n) of the sheet 2B to attain a new value for the gap Gap2(n) of the sheet 2B for the following reasons. Since the gap adjustment of the preceding sheet 2A is carried out after the gap measurement of the sheet 2*b* is accomplished at the position of the second gap sensor 21B, the value attained by subtracting the gap adjusting quantity of the sheet 2A from the gap Gap2(n) of the sheet 2B is an actual gap for the sheet 2B before the gap adjustment.

Step 105 is processing to determine whether or not the gap adjustment is required. That is, a check is made to determine whether or not the target gap value TGf of the sheet 2B is larger than Gap2(n). If the value TGf is smaller, the gap adjustment is unnecessary and hence the gap adjustment quantity X(n) is set to 0 and is supplied to the gap controller 67, thereby terminating the processing.

Conversely, when the gap value Gap2(n) is smaller, the gap adjustment is necessary. Consequently, to determine whether or not it is possible to delay the sheet 2, steps 107 to 110 are executed to conduct processing similar to the operation of steps 110 to 103 so as to calculate the target gap value TGb for the succeeding sheet 2*c*.

Control is next passed to step 111 to determine possibility of the gap adjustment. Namely, when the total of target gaps TGf+TGb is less than the total Gap2(n)+Gap2(n+1) of preceding and succeeding gaps of the sheet 2B, the preceding gap can be set to the target gap TGf regardless of the succeeding gap. Therefore, control is passed to step 112 in which a value obtained by subtracting the gap Gap2(n) of the sheet 2B from the target gap value TGf is used as the gap adjusting quantity X(n) of the sheet 2B. The value X(n) is then fed to the gap controller 67 and the processing is terminated.

If it is determined in step 111 that the gap adjustment is impossible, control is transferred to step 113 to determined whether or not the preceding target gap TGf can be ensured even if the succeeding target gap TGb cannot be guaranteed. In other words, a check is made whether or not the target gap TGf is less than a value obtained by adding the preceding and succeeding gaps of the sheet 2B, i.e., Gap2(n)+Gap2(n+1). In this regard, mj in step 113 indicates a marginal quantity to prevent collision between the sheets 2B and 2C. When it is determined that TGf can be ensured because TGf is less than the total of the preceding and succeeding gaps of the sheet 2B, control is passed to step 112 in which a value obtained by subtracting the gap Gap2(n) of the sheet 2B from the target gap value TGf is set to the gap adjusting quantity X(n) of the sheet 2B. The obtained value X(n) is fed to the gap controller 67 and then the processing is terminated.

When it is determined in step 113 that the target gap TGf cannot be ensured because of insufficient gaps before and after the sheet 2B, control is passed to step 114 to determine whether or not any delay is possible for the sheet 2B, i.e., whether or not the collision between the sheets 2B and 3C occurs due to the delay of the sheet 2B. For this purpose, a check is made to determine that the gap Gap2(n+1) after the sheet 2B is larger than the margin mj. When the gap Gap2(n+1) after the sheet 2B is less than the margin mj, the sheet 2*b* cannot be delayed. Therefore, control is transferred to step 106 to set the gap adjustment quantity X(n) to 0. The value X(n) is fed to the gap controller 67 and the processing is terminated.

When it is determined that the sheet 2*b* can be delayed, control is passed to step 115 in which a value attained by subtracting the margin mj from the succeeding gap Gap2(n+1) of the sheet 2B and then the resultant value is set to the gap adjustment quantity X(n). The value X(n) is delivered to the gap controller to thereby terminate the processing.

As above, when the total of the preceding and succeeding target gap values TGf and TGb of the sheet 2B is less than that of the preceding and succeeding gaps Gap2(n) and Gap2(n+1) thereof, the target gap TGf can be ensured without any problem.

Furthermore, in a case in which the target gap can be ensured under the condition of Gap2(n)+Gap2(n+1)<TGf+TGb, even when the succeeding gap of the sheet 2B is smaller than the target gap TGb, the target gap TGf is ensured. In this situation, the succeeding gap of the sheet 2B is smaller than the target gap TGb, the target gap TGb can be ensured by adjusting the gap for the sheet 2C and hence there arises no problem.

In addition, even in a case in which Gap2(n)+Gap2(n+1)<TGf+TGb holds and the target gap TGf cannot be ensured, when the preceding gap of the sheet 2B can be only slightly increased, there possible occurs a case in which G3–G4 takes a small value even when the value of G1–G2 is large s shown in the data of FIG. 6. Namely, this indicates possibility that a gap necessary for the opening or closing of the sort gate 16*a* is ensured.

As above, in accordance with the present invention, the sort shelf destinations of a sheet for the gap variation and its succeeding and preceding sheets as well as the variation in each of the preceding and succeeding gaps of the sheet are predicted to calculate the target gap value for the sheet. Therefore, there can be attained the gaps to store the sheets in the sort shelves in accordance with a small gap adjustment quantity.

In this connection, the target gap correction values of FIG. 10 associated with the broken line 200 of FIG. 9 are beforehand stored in the controller 66 in the description above. However, it will be more preferable that the first to fourth gap sensors measures data for a test sheet transported to automatically calculate a broken line 200 so as to automatically store target gap correction values (FIG. 10) in the controller 66, which automatically correct the characteristic fluctuation of each machine. Additionally, the characteristic of the broken line 200 is obtained by periodically transporting a test sheet for the comparison thereof with that of the initial broken line 200. Thanks to this provision, it is possible to monitor deterioration in the characteristic of the sort transporter 16. This leads to an advantageous effect, for example, that timing to change a belt can be recognized.

In addition, in accordance with the characteristic of the broken line 200 obtained as a result of periodical transportation of the test sheet, the target gap correction values of FIG. 10 are stored again in the storage, i.e., there can be obtained the most suitable correction values for the target gaps.

Moreover, through the automatic calculation of the broken line 200 in accordance with the detection results from the first to fourth sensors in the ordinary sorting operation, the target gap correction values 10 can be corrected to be automatically stored in the control means, it is possible to keep the most suitable correction values for the target gaps.

Additionally, the target gap value is altered depending on whether or not the section of the pertinent sheet is equal to that of the preceding sheet in step 100 of FIG. 8. If the sheets are to be stored in the same sort shelf, the target gap value may be determined in accordance with another criterion. For example, postcards can be stored in the associated sort shelves without any trouble thanks to a high value of flexural rigidity thereof even when the gap value is reduced.

Furthermore, in the description of the processing method of FIG. 8, when the gap adjustment is impossible (step 111 and subsequent steps), the preceding gap of the sheet 2B is preferentially increased to a maximum extent. However, there may be used a method to assign the preceding and succeeding target gaps TGf and TGb of the sheet in proportion to Gap2(n) and Gap2(n+1). Namely, the sheet gaps may be adjusted in accordance with $$TGf=(Gap2(n)+Gap2(n+1))\times TGf/(TGf+TGb)$$

$$TGb=(Gap2(n)+Gap2(n+1))\times TGb/(TGf+TGb).$$

In addition, although the gap adjustment quantity X(n) is a value equal to or more than 0, when TGf is less than Gap2(n) and particularly when TGb is more than Gap2(n+1), X(n) may be set to a negative value, namely, the sheet 2B is accelerated by the gap adjuster 10 to adjust the gap between the sheets.

Furthermore, when the sheets gap at the position of the gap adjuster 10 is used in place of that of the third gap sensor and the target gap correction values are obtained and memorized in accordance with the broken line 200 as described above, the third gap sensor may be removed from the apparatus.

As above, by adjusting the gap between the sheets 2*a* and 2*b* in accordance with the gap variation between the sheets 2*a* and 2*b* in a distance between the first and second gap sensors 21A and 21B and a distance between the gap adjuster 10 and the section path gate 25 or the sort shelf 11, the sheets 2 sequentially transported can be sorted with high reliability.

Figure 11:
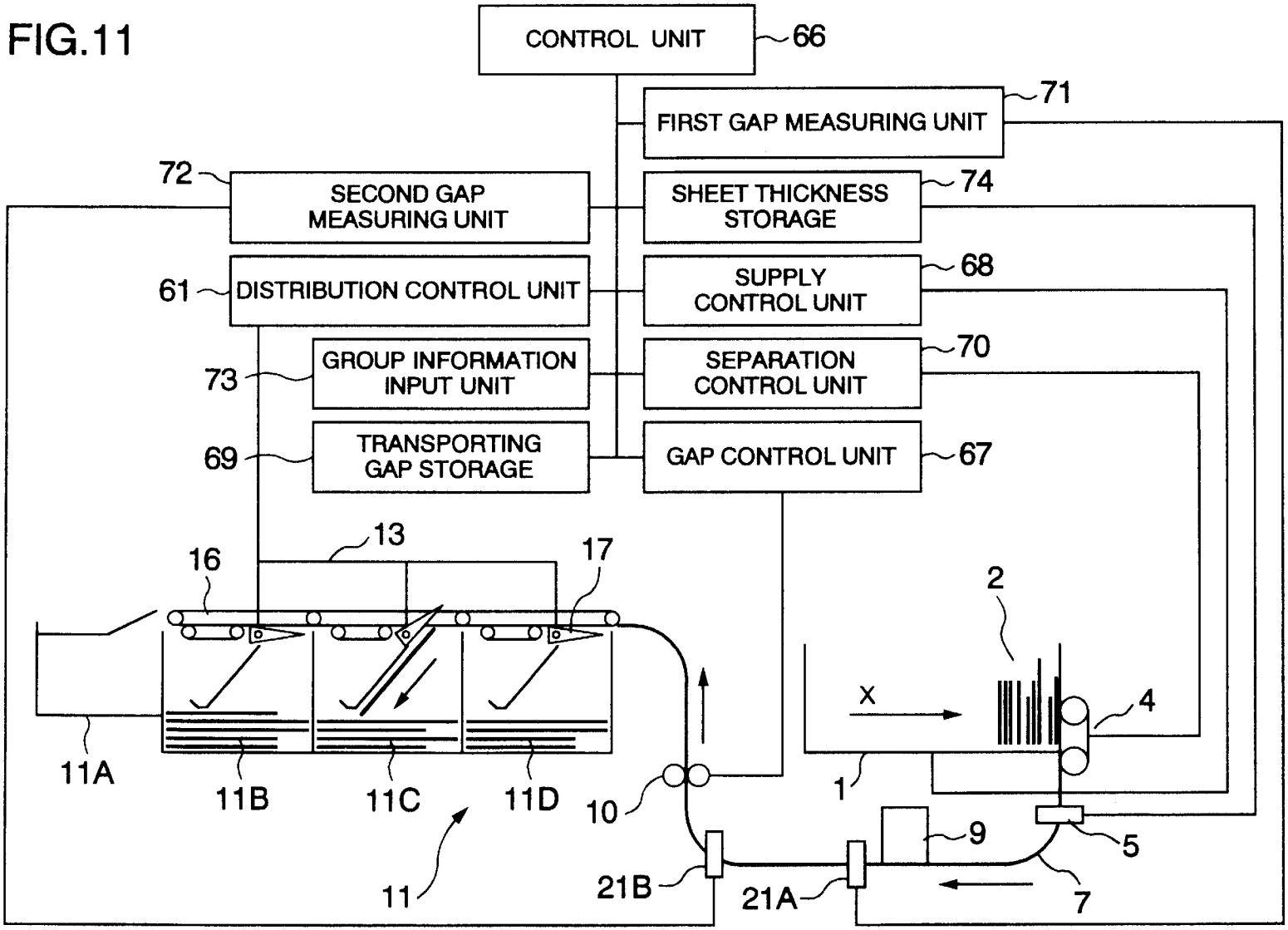
FIG. 11 is a diagram showing a control system for explaining a second control method of the paper sorting apparatus in accordance with the present invention.

FIG. 11 shows in a control system diagram a second control method of the paper sorting apparatus in accordance with the present invention. In FIG. 11, the primary configuration is substantially equal to the control system to which the first control method shown in FIG. 6 is applied. The same components as those of FIG. 6 are assigned with the same reference numerals. In conjunction with FIG. 11, description will be given of a control operation in which sheets 2 are transported from the supply unit 1 to be sorted into the storage shelves 11.

A supply control unit 68 conducts a control operation such that the first one of the sheets 2 installed in the supply unit 1 is located at a predetermined position. The sheet 2 is controlled to appropriately proceed in a direction of an arrow X. A separation control unit 70 supervises a separator unit 4 to control a gap between the sheets 2 to be fed to a transporter unit 7.

The sheet 2 separated by the separator 4 is delivered by the transporter 7 to pass through a detector unit 5. A paper thickness storage unit 74 stores therein thickness of a sheet measured by the detector 5.

A first gap measuring unit 71 measures a gap between two successively transported sheets 2 beginning at an on/off signal from a gap sensor 21A. A second gap measuring unit 72 measures a gap between two successively transported sheets 2 beginning at an on/off signal from a gap sensor 21B. Although not shown in FIG. 11, third and fourth gap sensors are disposed also in the second control method of the present invention in the same way as for the first control method of the present invention described by referring to FIG. 6.

A transportation gap storage 69 stores therein and outputs therefrom the measured results of the first and second gap measuring units 71 and 72. A sort information input unit 73 stores therein and outputs therefrom sort information of the sheets 2 read by a reader unit 9 (an address reader 9*a*, a bar code reader 9*b*, or a bar code reader 9*c*).

A gap control unit 67 supervises a gap adjuster unit 10 to control a gap between two sequentially transported sheets 2. A distribution control unit 61 opens or closes a section path gate 25 (reference is to be made to FIG. 1) and a sort gate 17 corresponding to a sort shelf 11 to thereby distribute the sheet 2.

A control unit 66 controls the supply controller 68, the separation controller 70, the first and second gap measuring units 71 and 72, the transportation gap storage 69, the sort information input unit 73, the distribution controller 61, and the gap controller 67. The controller 66 achieves various processing for calculations and operations. When the third and fourth gap sensors 150 and 151 are to be operated, there are disposed third and fourth gap measuring units respectively corresponding thereto, and operation thereof is controlled by the controller 66.

When a sheet 2 reaches the gap controller 67, the controller 66 calculates a gap adjustment quantity in accordance with the preceding and succeeding gaps of the sheet 2 measured by the first and second gap measuring units 71 and 72 and stored in the gap storage 69 and the thickness of a sheet before the pertinent sheet 2 stored in the thickness storage 74 and then delivers a result of the calculation to the gap controller 67. In this connection, the method of calculating the gap adjustment quantity will be described later.

The gap controller 67 varies, as can be seen from FIG. 2, the rotary speed of the roller 30 after the preceding sheet 2A passes the roller 30 in response to an instruction issued from the controller 66. By changing the rotary speed of the roller 30, the controller 67 varies the feed speed of the succeeding sheet 2B. For example, as shown in FIG. 7, the gap between the sheets 2A and 2B are adjusted from Gap2(n) to Gap2'(n).

The sheet 2 of which the gap is adjusted by the gap adjuster 10 is then fed to the section path gate 25. The distribution controller 61 opens or closes the gate 25 at timing of arrival of the sheet 2 from the adjuster 10 at the gate 25 to thereby distribute the sheet to corresponding one of the sort transporter units 16A to 16H.

Additionally, the distribution controller 61 supervises in accordance with the sort information indicated on the sheet 2 the opening or closing of each sort gate 17 of the sort transporter 16. The gate 17 is disposed for each sort shelf 11. Through the opening or closing of the sort gate 17, the sheet 2 is stored in the sort shelf 11 by the sort transporter 16. In the operation, a sheet 2 which cannot be delivered to any sort shelf 11 is stored in a reject sort shelf 11A.

In this case, the distribution controller 61 checks to determine whether or not a gap between the pertinent sheet and a consecutive sheet is larger than a threshold value G. If the sheet gap is less than the threshold value G, the sort gate 17 cannot be opened or closed and hence the succeeding sheet 2 is delivered to the reject sort shelf 11A. If the sheet gap is more than the threshold value G, it is possible to open or to close the sort gate 17 and consequently the sheet 2 is delivered to the associated sort shelf 11.

In the second control method of the present invention, the threshold value is determined by thickness of the preceding sheet 2A. Reasons for the determination will be described by referring to FIGS. 12 to 15.

Figure 12:
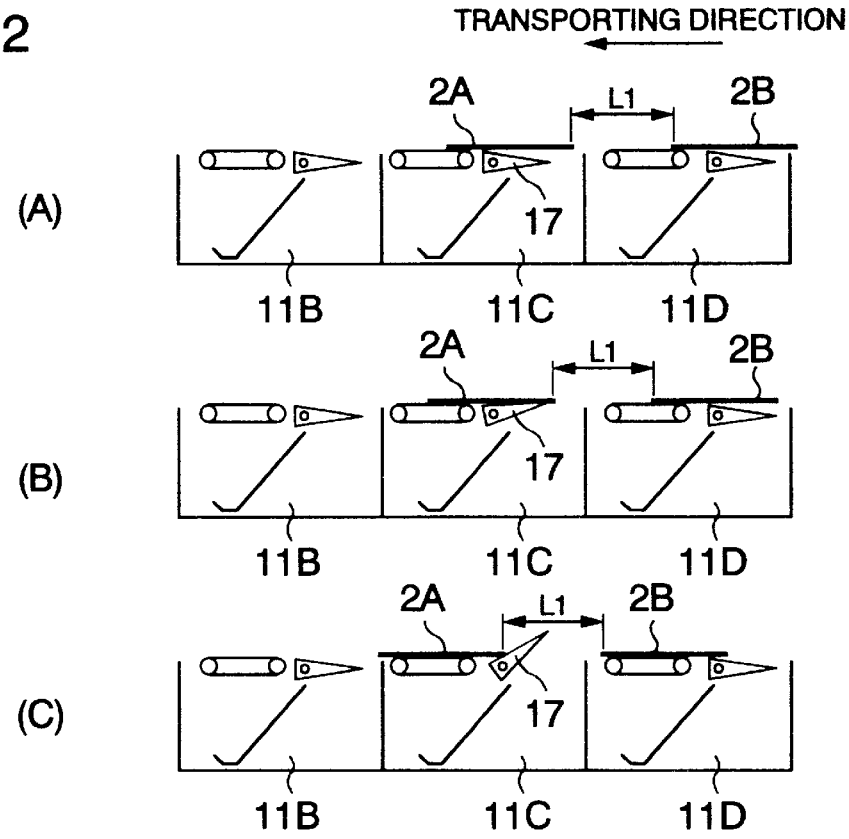
FIGS. 12 to 15 are diagrams showing operation of inserting a sheet of paper in a sort shelf in a time series.
Figure 13:
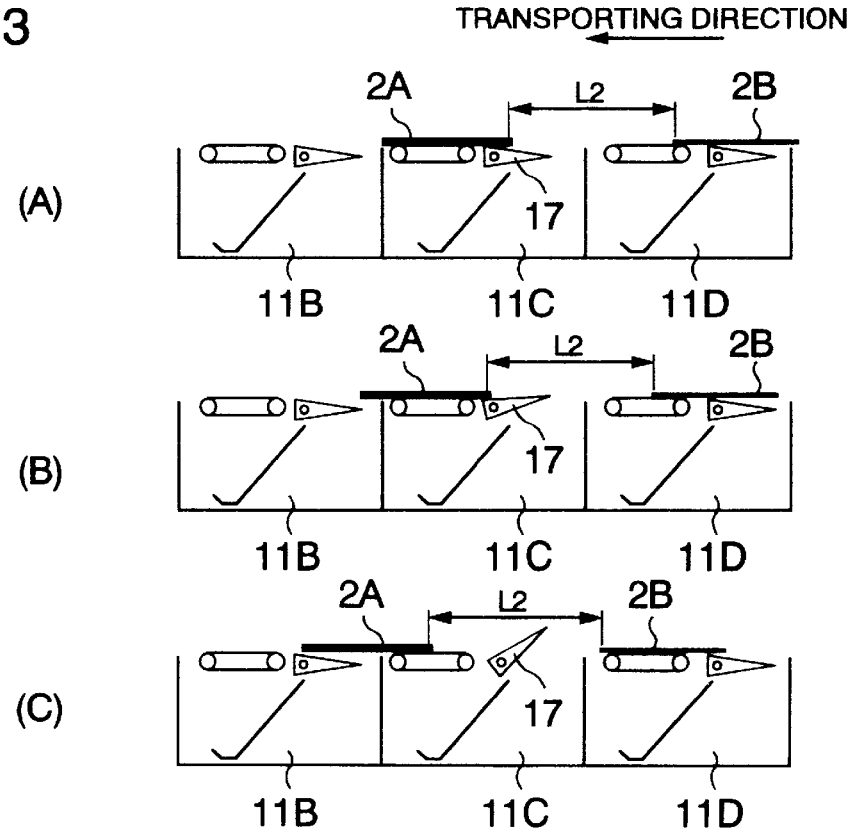
Figure 14:
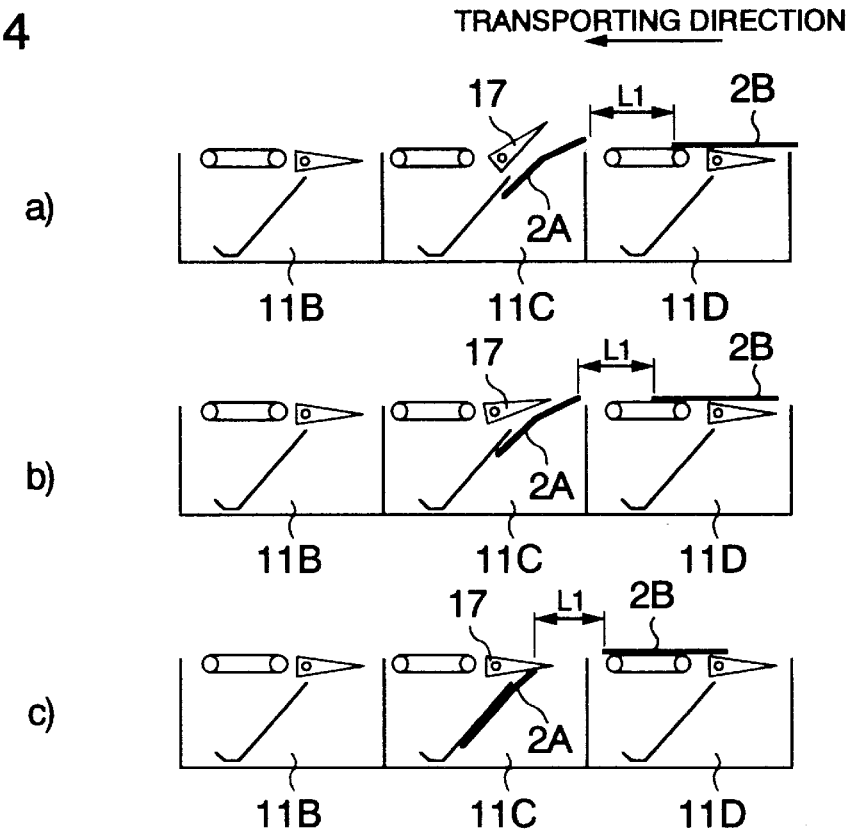
Figure 15:
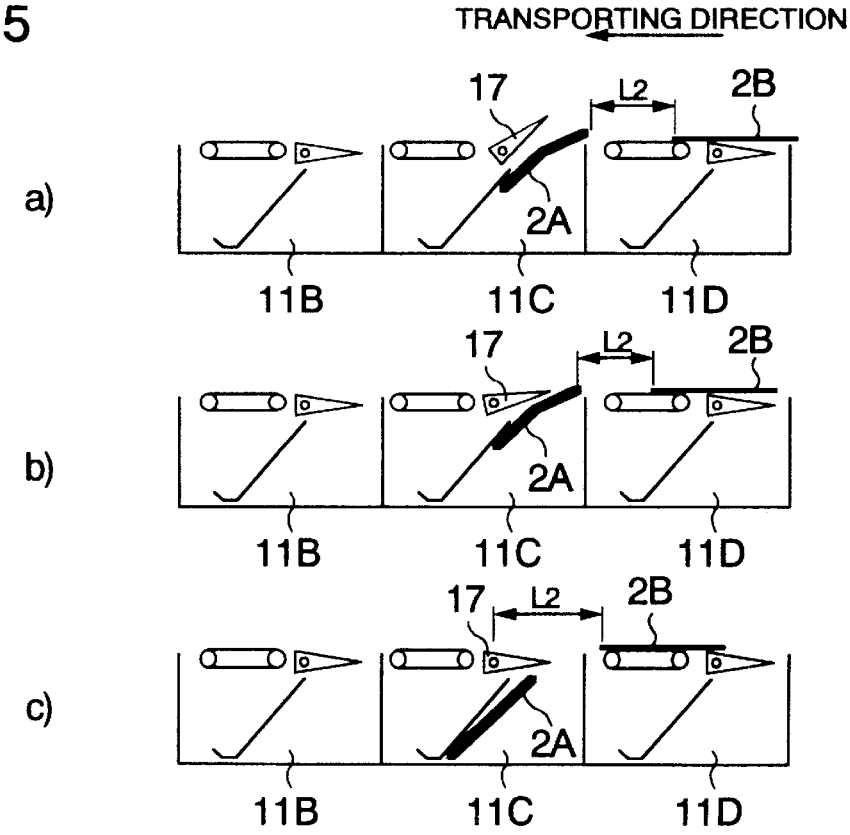

FIGS. 12 and 13 show an operation in time series for two consecutively transported sheets 2A and 2B in which the sheet 2B is delivered to a sort shelf 11*c*. FIGS. 14 and 15 show an operation in time series for two consecutively transported sheets 2A and 2B in which the sheet 2A is fed to a sort shelf 11*c*. In the time series of FIGS. 12 and 14 as well as in FIGS. 13 and 15, the sheet 2A is thin and thick, respectively.

In FIG. 12, before the preceding sheet 2A completely passes over the sort gate 17, the gate 17 starts opening (FIG. 12(*b*)) and then the gate 17 finishes the opening operation while being brought into contact with the sheet 2A (FIG. 12(*c*)). Even when the sheet 2A is brought into contact with the gate 17, neither the sheet 2A nor the gate 17 is damaged to a considerable extent if the sheet 2A is thin. Therefore, the gap L1 between the sheets 2A and 2B can be minimized.

In FIG. 13, after the preceding sheet 2A completely passes over the sort gate 16*a*, the gate 17 starts opening (FIG. 13(*b*)) and then the gate 17 finishes the opening operation in which the gate 17 is not brought contact with the sheet 2A (FIG. 13(*c*)). When the sheet 2A is thick, if the operation of FIG. 12 is carried out, the sheet 2A may possible damaged and/or an excessive force may be applied to the gate 17 to resultantly damage the gate. Consequently, it is necessary that the gap between the sheets 2A and 2B is greater than the distance L1 of FIG. 4.

In FIG. 14, the sort gate closes while being brought into contact with the sheet 2A. Moreover, in FIG. 15 like FIG. 13, the gate 17 closes without being brought into contact with the sheet 2A.

As described above, the threshold value G is changed in accordance with the thickness of the preceding sheet 2A. In this connection, the threshold value G may be proportional to the thickness of the sheet or there may be used two threshold values, i.e., a value equal to or less than a thickness and a value equal to or more than the thickness.

Figure 16:
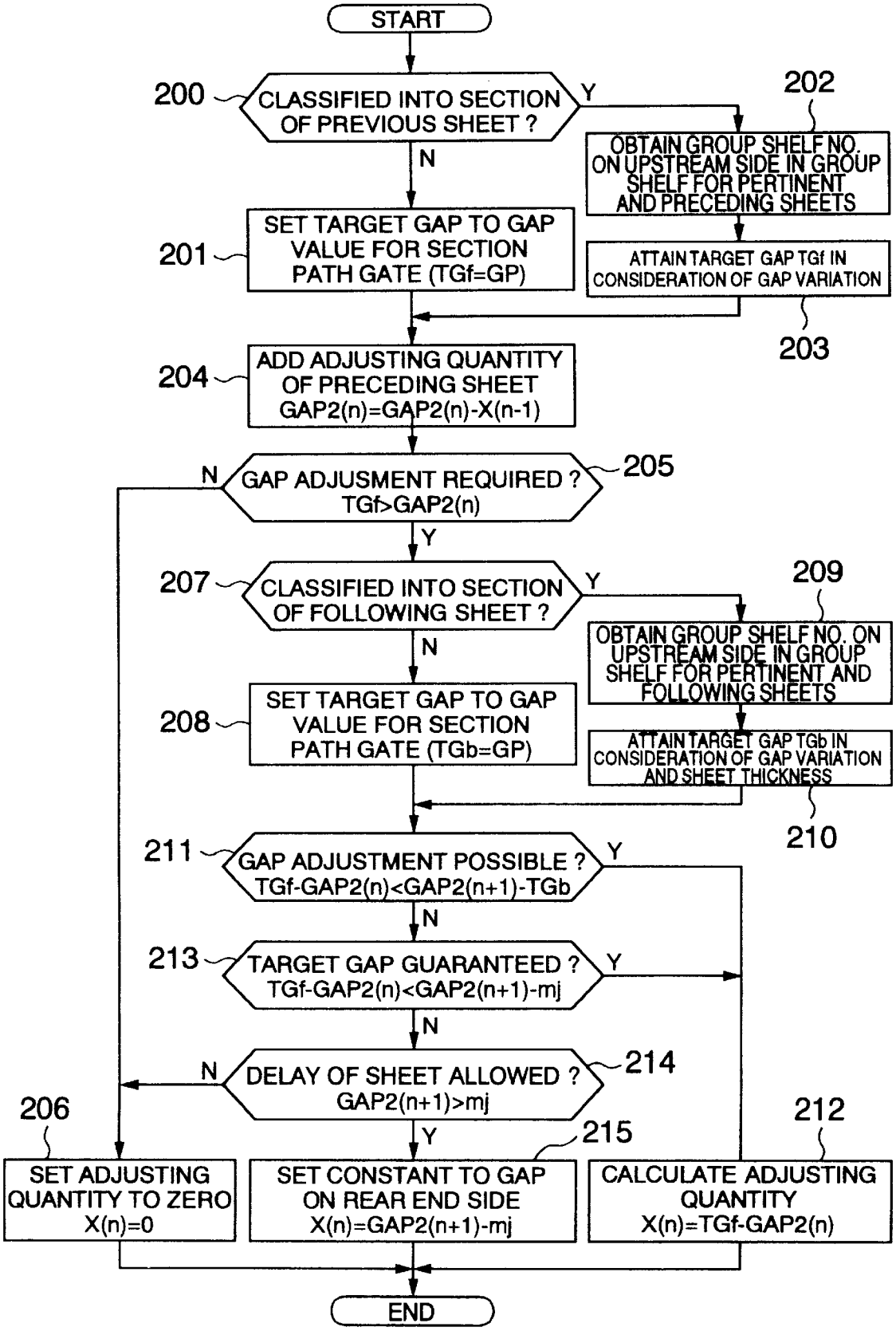
FIG. 16 is a flowchart showing an operation to calculate a gap adjusting quantity in the first control method in accordance with the present invention.

Referring subsequently to FIGS. 7 and 16, description will be given of a method of calculating the gap adjusting quantity in accordance with the preceding and succeeding gaps of the sheet 2 measured by the first and second gap measuring units 71 and 72 and stored in the gap storage 69 and the destination sorts of the preceding and succeeding sheets of the sheet 2.

FIG. 16 shows in a flowchart of calculating the gap adjustment quantity in the second control method of the present invention. In the flowchart shown in FIG. 16, description will be avoided for the same procedures as those of the flowchart of calculating the gap adjustment quantity in the first control method of the present invention shown in FIG. 8. In this connection, the procedures in the flowcharts of FIGS. 16 and 8 are assigned with step numbers in a corresponding manner.

The flowchart of FIG. 16 differs from that of FIG. 8 in steps 203 and 210 to attain the target gap TGf. Namely, in step 203, the target gap correction value is obtained in accordance with the difference between the gap G1 of the sheet 2 measured by the first gap measuring unit 71 and the gap G2 (Gap2(n) of FIG. 7) measured by the second gap measuring unit 72 which are stored in the gap storage 69 and the sort shelf number obtained in step 202. When G1–G2 is two millimeters and the sort shelf number is 16, the target gap correction value is obtained as 22 millimeters. Thereafter, a gap value Gr necessary for the opening and closing of the sort gate 17 is added to the correction value to resultantly obtain the target gap value TGf. In this situation, the gap value Gr necessary for the opening and closing of the sort gate 17 is determined in accordance with thickness of the preceding sheet 2A as described in the determination of the threshold value G for the opening and closing of the gate 17.

When it is determined that the gap adjustment is necessary in step 205, there are executed processing of steps 207 and 209, and then to determine whether or not the sheet 2B can be delayed, the target gap value TGb of the succeeding sheet 2C is calculated in step 210 in almost the same way as for the processing of step 203.

In accordance with the second control method of the present invention described above, there can be obtained an advantageous effect similar to that of the paper sorting apparatus to which the first control method of the present invention is applied; moreover, it is possible to increase the advantageous effect.

In accordance with the second control method of the present invention, since the target gap value of the sheet is calculated in accordance with thickness of the preceding sheet, destination sort shelves of the preceding and succeeding sheets of the sheet for which the gap is to be adjusted, and predicted values of gap variations before and after the sheet, there can be obtained the gap values by a slight gap adjustment quantity, the values ensuring the sheets to be delivered to destination sort shelves.

Figure 17:
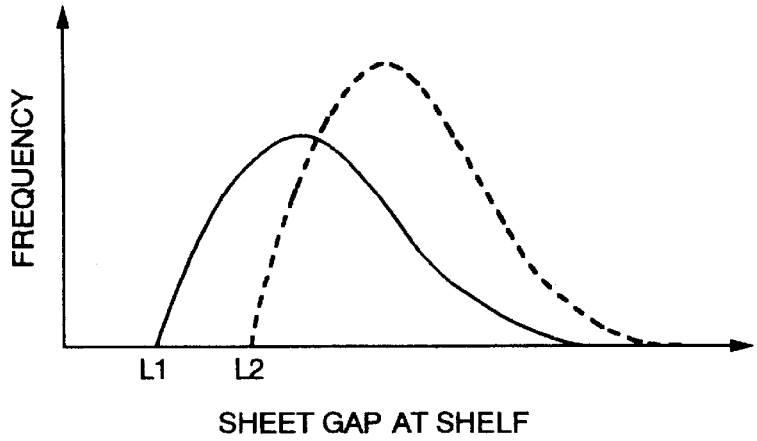
FIG. 17 is a graph for explaining a relationship between frequency of appearances and sheet gaps for two values of thickness.

FIG. 17 shows a relationship between thicknesses of sheets normally stored in sort shelves and sheet gap values immediately before the delivery thereof in the shelves.

The abscissa stands for the gap values and the ordinate indicates frequency of appearances of sheets, and a solid line represents data of sheets having a thickness less than a predetermined value, e.g., one millimeter and a dotted line stands for data of sheets having a thickness equal to or more than, for example, one millimeter.

As can be seen from FIG. 17, when compared with the case in which the threshold value G and the gap value Gr are determined regardless of the sheet thickness (e.g., L2), there exist a larger number of sheets which can be transported with a smaller value of the gaps therebetween. Therefore, the processing can be achieved with higher performance without increasing the number of rejected sheets.

In this connection, the target gap correction values of FIG. 10 obtained by use of the curve 200 shown in FIG. 9 are beforehand stored in the controller 66 in the description above. As in the first and second control methods of the present invention, it is effective to update, to correct, to optimize, and/or to reset the target gap correction values of FIG. 10.

Moreover, in step 200 of FIG. 16, the target gap value is altered in accordance with whether or not the pertinent sheet and the preceding sheet belongs to the same section. However, in addition, when these sheets are to be delivered to the same sort shelf, the target gap value may be determined in accordance with another standard. For example, when handling postcards, since the postcards have a high value of flexural rigidity, even when the gap value is minimized, it is possible to deliver the cards to the sort shelf without any difficulty.

Additionally, in the processing of FIG. 16, when the gap adjustment is impossible (step 211 and subsequent steps), the gap before the sheet 2B takes precedence and is enlarged to a possibly maximum extent in the method. However, the preceding and succeeding target gaps TGf and TGb may be assigned in proportion to the gaps Gap2(n) and Gap2(n+1) before and after the sheet as follows.

$$TGf=(Gap2(n)+Gap2(n+1))\times TGf/(TGf+TGb)$$

$$TGb=(Gap2(n)+Gap2(n+1))\times TGb/(TGf+TGb)$$

This gap adjustment is also utilized without departing from the gist of the present invention.

Figure 18:
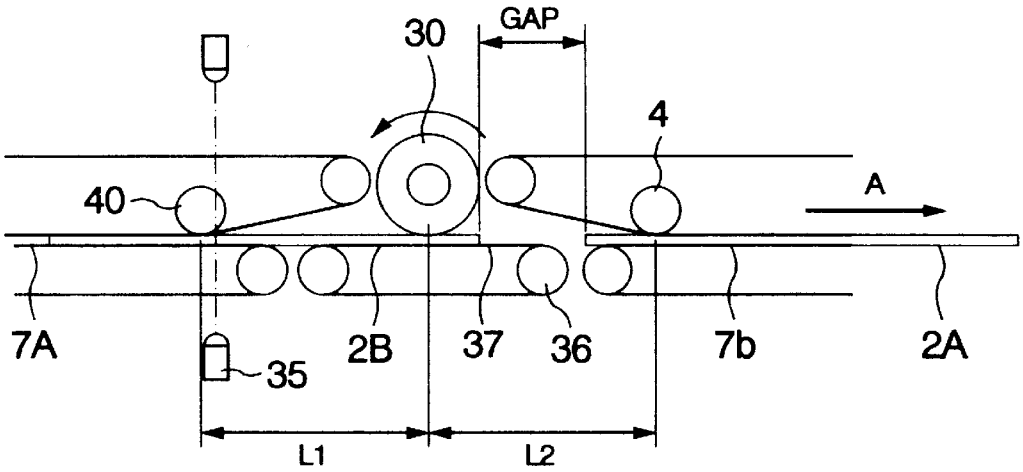
FIGS. 18 to 25 are diagrams showing configurations respectively of second to third embodiments of the gap adjusting unit in accordance with the present invention.

FIG. 18 shows a second embodiment of the gap adjuster 10 in which the same components as those of FIG. 2 are assigned with the same reference numerals. Numeral 37 indicates a flexible belt which is installed on pulleys 36 to be driven by a driving unit, not shown, to a speed substantially equal to a peripheral speed of a roller 30.

Thanks to the configuration, even when sheets 2 such as relatively thick letters are transported thereinto, it is possible to grasp the sheets 2 between the roller 30 and the belt 35 so as to adjust the gaps between the sheets 2.

Figure 19:
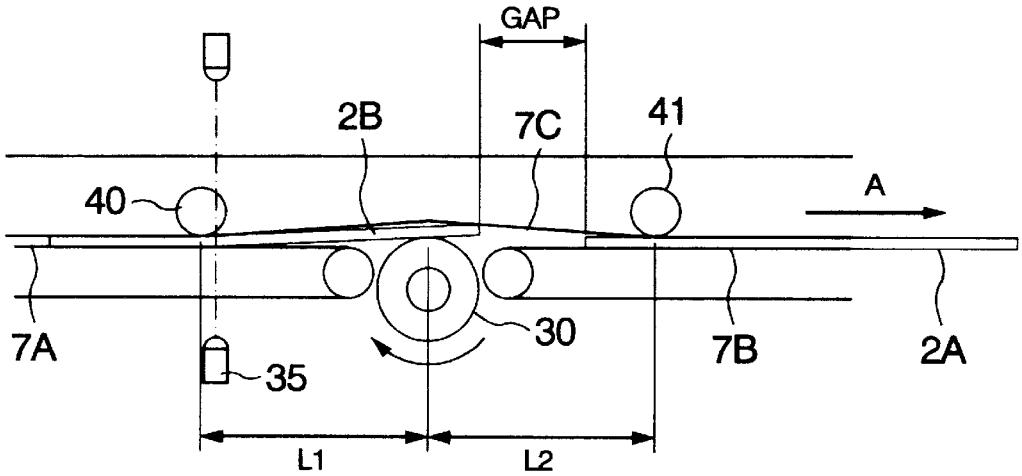

FIG. 19 shows a third embodiment of the gap adjuster 10 in which the same components as those of FIG. 2 are assigned with the same reference numerals. Numeral 7*c* indicates a flexible belt having a surface opposing to a roller 30, the surface being fabricated (or coated) with a substance of low friction. The coefficient of friction between the belt 7*c* and the sheet 2 is less than that between the roller 30 and the sheet 2.

In the configuration, sheet 2*b* is grasped between the roller 30 and the belt 7*c* such that the rotary speed of the roller 30 is changed to adjust the gaps between the sheets 2 by changing the feeding speed of the sheet 2*b*. In this situation, the sheet 2*c* slips on the belt 7*c* due to the small coefficient of friction.

Figure 20:
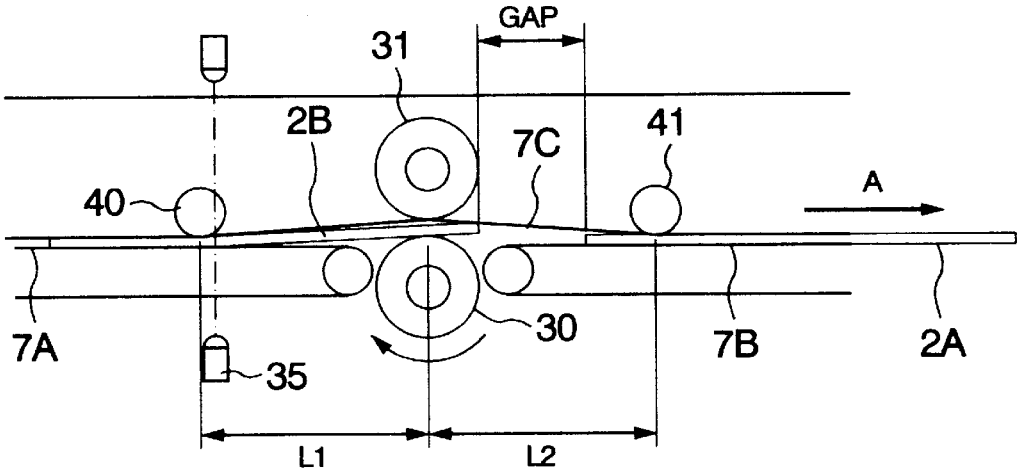

FIG. 20 shows a fourth embodiment of the gap adjuster 10 in which the same components as those of FIG. 19 are assigned with the same reference numerals. Numeral 31 denotes a backup roller formed with a soft material such as sponge to push the belt 7*c* such that the sheet 2 is pressed against the roller 30 with an appropriate force.

Due to the construction, there is prevented occurrence of an event in which the sheet 2 is moved upward by thickness and/or flexural rigidity thereof, which ensures the transportation of the sheets.

In the gap adjuster 10 shown in FIGS. 2, 18, 19, and 20, the gap of the sheet 2 can be adjusted in a range from where the last end of the sheet 2 is released from the grasped state by the belt 7*a* on the upstream side to where the first end of the sheet 2 is grasped by the belt 7*b* on the downstream side.

The distance E thereof is represented as E=11+12−L, where L stands for the length of the sheet 2, 11 indicates the distance from where the last end of the sheet 2 is released from the grasped state by the belt 7*a* on the upstream side to where the sheet 2 is grasped by the roller 30, and 12 designates the distance from where the sheet 2 is released from the grasped state by the roller 30 to where the sheet 2 is grasped by the belt 7*b* on the downstream. Under this condition, when it is assumed that the sheet 2 is a postcard and the length L is 148 mm and 11=12=140 mm, the distance E available for the gap adjustment is obtained as 132 mm. Moreover, when it is assumed that the sheet 2 is a letter and the length L is 235 mm and 11=12=230 mm, the distance E available for the gap adjustment becomes 225 mm.

However, when cards and letters are transported in a mixed fashion, if 11 and 12 are 140 mm, there is only available 45 mm as the distance E for the gap adjustment of letters. It is impossible in this distance to decelerate and/or re-accelerate the letters for the adjustment of the gaps therebetween. Furthermore, when 11 and 12 are assumed to be 230 mm, it is impossible to transport cards in a stable state.

In consequence, the gap adjuster 10 shown in FIGS. 2, 18, 19, and 20 is effective when the transported sheets 2 are of a fixed size.

Figure 21:
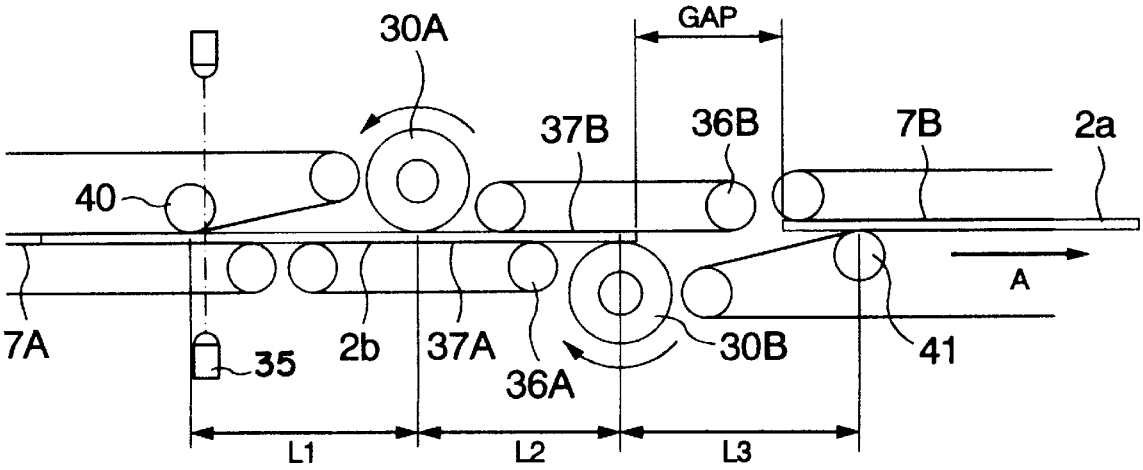

FIG. 21 shows a fifth embodiment of the gap adjuster 10 in which 30A and 30B indicate rollers arranged with a predetermined interval between belts 7*a* and 7*b*, the rollers being driven by servo motors, not shown. Numerals 37A and 37B indicate flexible belts to be installed respectively between pulleys 36A and 36B, the belts being driven by driving units, not shown, at speeds substantially equal to those of the rollers 30A and 30B, respectively.

In other words, in the configuration of this embodiment, two units of gap adjusters 10 shown in FIG. 18 are arranged in series with the rollers 30B and 37B vertically opposing to each other in the drawing.

In the constitution above, the interval in which the gap of the sheet 2 can be adjusted is from where the last end of the sheet 2 is released from the grasped state by the belt 7*a* on the upstream side to where the first end of the sheet 2 is grasped by the roller 30 on the downstream side.

The distance E thereof is represented as E=11+12+13−L, where L stands for the length of the sheet 2, 11 indicates the distance from where the last end of the sheet 2 is released from the grasped state by the belt 7*a* on the upstream side to where the sheet 2 is grasped by the roller 30, and 12 denotes the distance between the axes of the rollers 30A and 30B, and 13 designates the distance from where the sheet 2 is released from the grasped state by the roller 30 to where the sheet 2 is grasped by the belt 7*b* on the downstream. Under this condition, when it is assumed that the sheet 2 is a postcard and the length L is 148 mm and 11=12=13=140 mm, the distance E available for the gap adjustment is obtained as 272 mm. Moreover, even when it is assumed that the sheet 2 is a letter and the length L is 235 mm, the distance E available for the gap adjustment becomes 185 mm.

In consequence, when cards and letters are transported in a mixed manner, when 11, 12, and 13 are 140 mm, the gap adjustment can be achieved for the sheets 2 including cards and letters. Moreover, the sheets 2 can be transported with high reliability regardless of the size thereof.

Figure 22:
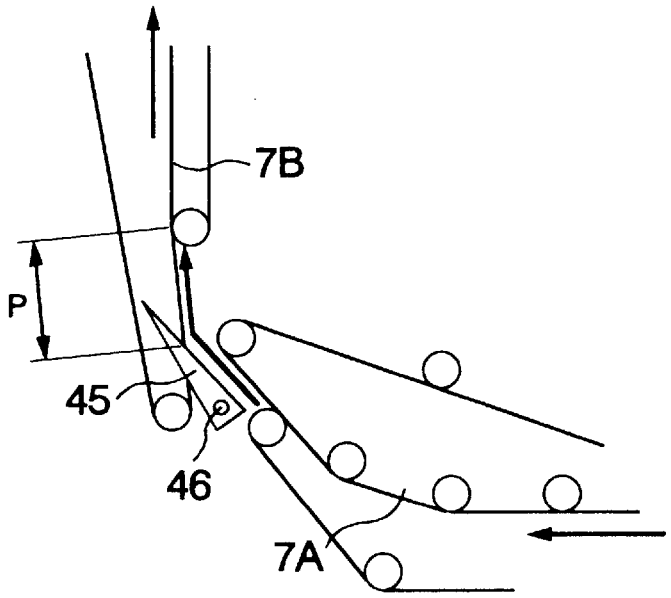
Figure 23:
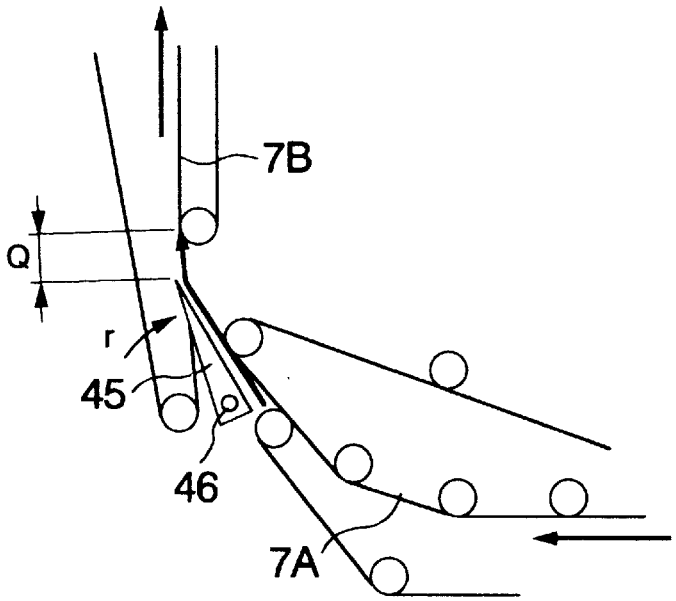

FIGS. 22 and 23 show a fifth embodiment of the gap adjuster 10 in which 7*a* is a belt on the upstream side, 7*b* is a belt on the downstream side, and 46 indicates a gate which is supported on a rotary shaft 46 to be located at a position in the sheet transporting path of the belts 7*a* and 7*b*. In this connection, the shaft 46 is driven by a driving unit, not shown, to reciprocally rotate in a zone defined by a predetermined angle.

In this configuration, when the position of the gate 45 is changed in the swinging action thereof as shown in FIGS. 22 and 23, the transporting path of the first end of the sheet transported by the belt 7*a* on the upstream side is altered. Therefore, the sheet gap can be adjusted for the difference in the path in a range up to where the sheet reaches the belt 7*b* on the downstream side.

Figure 24:
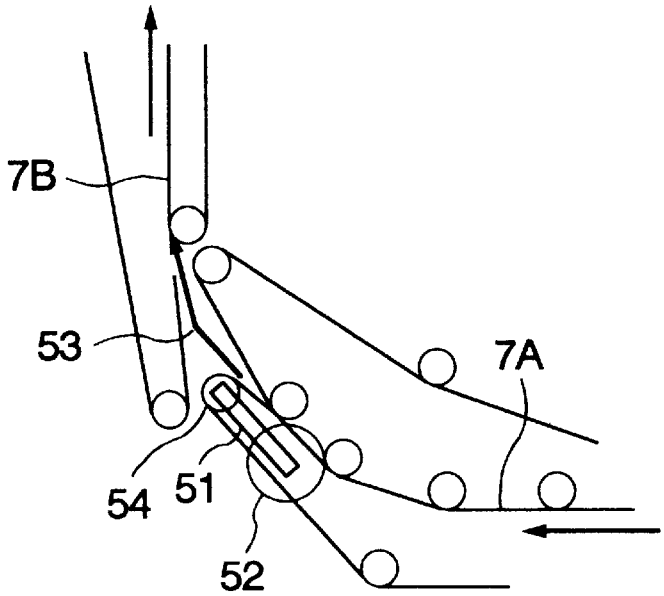
Figure 25:
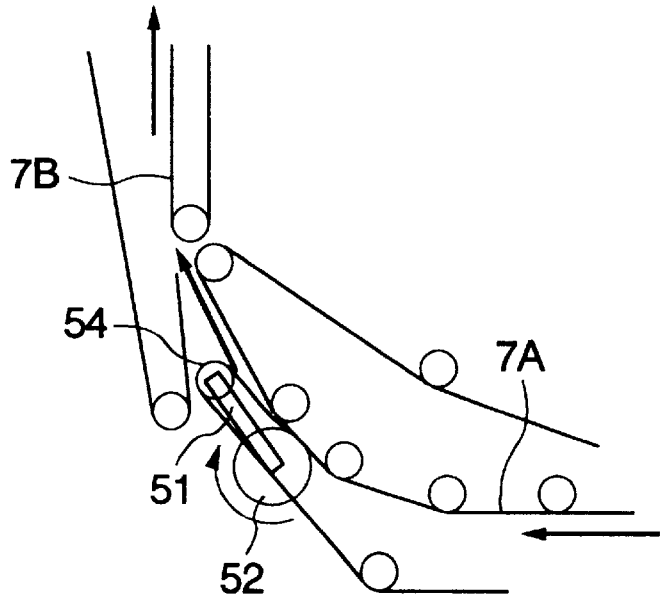

FIGS. 24 and 25 shows a seventh embodiment of the gap adjuster 10 in which the same constituent components as those of FIG. 22 are assigned with the same reference numerals. Numeral 52 denotes a rotary actuator, 51 is a swing arm of which an end is fixed onto the actuator 52, and 54 indicates a pulley which is rotatably supported on the swing arm 51 and on which the belt 7*a* is installed.

In the construction, when the position of the pulley 54 is varied by the actuator 52 as shown in FIGS. 24 and 25, the transporting path of the first end of the sheet transported by the belt 7*a* on the upstream side is altered. Therefore, the sheet gap can be adjusted for the difference in the path in a range up to where the sheet reaches the belt 7*b* on the downstream side.

When the sheets fed by the transporter are of the same kind, the frictional force of the belts 7*a* and 7*b* is not changed and hence the gap variation during the transportation is reduced. Consequently, although the adjustable gap quantity is small in the gap adjusters shown in FIGS. 22 to 25, when there are required to handle a large number of sheets of the same kind, such as postcards of New Year's greetings and items of direct mail, the gap adjusters can be efficiently utilized.

Figure 26:
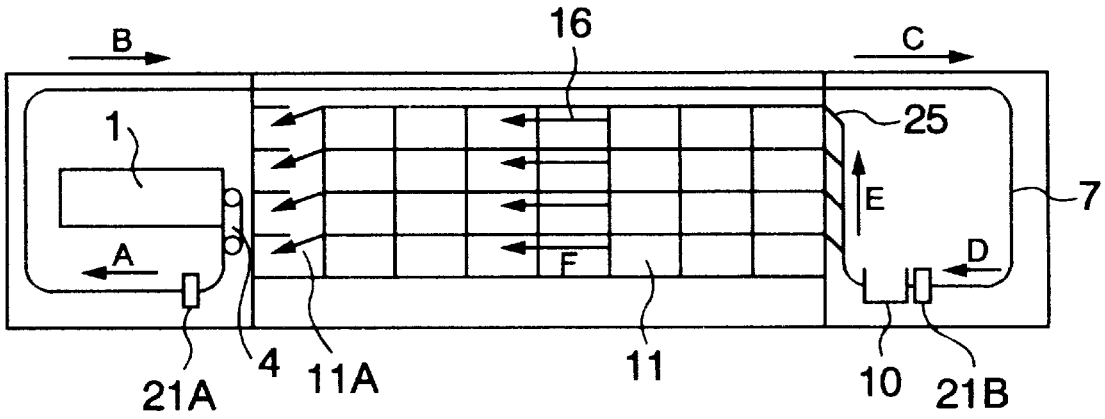
FIGS. 26 and 27 are front views respectively showing second and third embodiment of the paper sorting apparatus in accordance with the present invention.

FIG. 26 shows in a front view a second embodiment of the paper sorting apparatus in accordance with the present invention. In FIG. 26, the same components as those of FIG. 1 are assigned with the same reference numerals.

Figure 27:
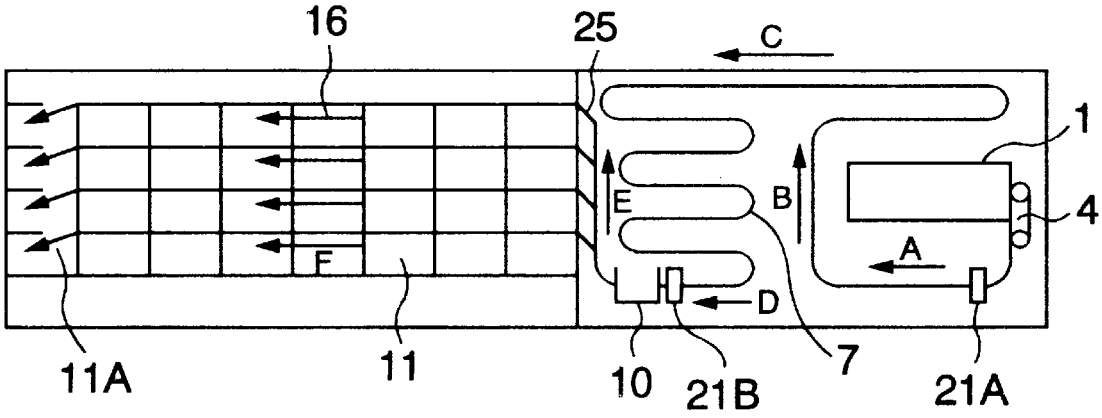

FIG. 27 shows in a front view a third embodiment of the paper sorting apparatus in accordance with the present invention. In this diagram, the same components as those of FIG. 1 are assigned with the same reference numerals.

In the paper sorting apparatuses shown in FIG. 26 and 27, the sheet transportation path of the transporter 7 between the first and second gap measuring units 21A and 21 is elongated so that the change in the sheet gap can be more correctly measured during the transportation of the sheets.

The sheet gap changing in a range from the gap adjuster 10 to the section path gate 25 or the sort shelf 11 can be more correctly predicted by exactly measuring gaps between the sheets, which makes it possible to adjust the sheet gap with a higher precision.

Incidentally, in conjunction with the description of the embodiments above, description has been given of an example in which the first gap measuring unit 21A is arranged in the proximity of the separator 4. However, the installation position of the unit 21A is not limited to the vicinity of the separator 4. Namely, in relation to the transporter 7, the unit 21A may be disposed at any upstream position of the second gap measuring unit 21B.

In accordance with the present invention, the gap between the sheets distributed through the section path gate and/or the sort shelf can be retained in an appropriate manner and hence it is possible to prevent occurrence of transportation jam of sheets in each gate; moreover, it is possible to prevent the reduction in the processing performance due to occurrence of rejection of sheets. Consequently, there can be provided a paper sorting apparatus capable of achieving a high-speed sorting operation with high reliability.

While the present invention has been described with reference to the particular illustrative embodiments, it is not to be restricted by those embodiments but only by the appended claims. It is to be appreciated that those skilled in the art can change or modify the embodiments without departing from the scope and spirit of the present invention.

We claim:

1. A paper sorting apparatus, comprising:

transporting means for transporting each of separated sheets of paper and the like;

first gap measuring means for measuring a gap between sheets on an upstream side of the transporting means;

second gap measuring means disposed on a downstream side of the first gap measuring means for measuring a gap between transported sheets;

gap adjusting means disposed on a downstream side of the second gap measuring means for adjusting a gap between transported sheets; and control means for issuing an indication to the adjusting means in accordance with the gap measure by the first gap measuring means and the gap measure by the second gap measuring means and thereby adjusting the gaps before and after the sheet to values most suitable for the sorting of the sheets.

2. A paper sorting apparatus in accordance with claim 1, further including:

reading means disposed along the transporting means for reading sort information indicated on each sheet; and sort shelves to which the sheets distributed by sort transporting means are delivered, the sort transporting means distributing transporting paths of the respective sheets, wherein the control means adjusts, in accordance with the sort information read from the sheet, the gaps of the sheet in accordance with the sort shelf to which the sheet is to be delivered.

3. A paper sorting apparatus in accordance with claim 2, wherein the control means adjusts, in accordance with a gap variation characteristic of the sheet on a downstream side of the adjusting means, the gaps of the sheet by the gap adjusting means in accordance with a gap variation of the sheet taking place between the first and second gap measuring means.

4. A paper sorting apparatus in accordance with claim 3, wherein the control means includes gap correction values associated with the sheet gap variation characteristic on the downstream side of the adjusting means, the control means adjusting the gaps of the sheet by the gap adjusting means in accordance with the gap correction values.

5. A paper sorting apparatus in accordance with claim 4, further including third gap measuring means and fourth gap measuring means on a downstream side of the gap adjusting means, wherein the control means includes gap correction values associated with the sheet gap variation characteristic associated with measured results respectively from the third and fourth gap measuring means.

6. A paper sorting apparatus in accordance with claim 5, wherein the control means calculates a sheet gap variation characteristic of the sort transporting means in accordance with measured results from the first to fourth gap measuring means to thereby modify the gap correction values.

7. A paper sorting apparatus in accordance with claim 6, wherein the control means calculates, when a test sheet of paper and the like is transported, the sheet gap variation characteristic.

8. A paper sorting apparatus in accordance with claim 2, further including gate means on a downstream side of the gap adjusting means, wherein the sheets are sorted to a plurality of sort transporting means under control of the control means.

9. A paper sorting apparatus in accordance with claim 8, wherein the control means makes, when sorting a sheet, a comparison between the sheet and a sheet transported immediately before the pertinent sheet for determining whether or not the pertinent sheet and the preceding sheet are to be sorted to an identical one of the sort transporting means, and controls the gap of the pertinent sheet, when the sheet and the preceding sheet are sorted to different ones of sort transporting means, to a value enabling the gate means to sort the sheet.

10. A paper sorting apparatus in accordance with claim 8, wherein the control means makes, when sorting a sheet, a comparison between the sheet and a sheet transported immediately before the pertinent sheet for determining whether or not the pertinent sheet and the preceding sheet are to be sorted to an identical one of the sort transporting means, and adjusts by the gap adjusting means the gap of the pertinent sheet in accordance with a sheet gap variation characteristic on a downstream side of the adjusting means, when the sheet and the preceding sheet are sorted to the same sort transporting means, in accordance with a sheet gap variation taking place between the first and second gap measuring means.

11. A paper sorting apparatus in accordance with claim 10, further including thickness measuring means disposed at an intermediate point of the transporting means for measuring thickness of a sheet transported by the transporting means, wherein the control means adjusts by the gap adjusting means the gap of the sheet in accordance with a sheet gap variation characteristic on a downstream side of the adjuster, a measured result from the thickness measuring means, and a sheet gap variation taking place between the first and second gap measuring means.

12. A paper sorting apparatus in accordance with claim 8, wherein the control means makes, when sorting a sheet, a comparison, when a gap adjustment is required between the pertinent sheet and a sheet transported immediately before the sheet, between the sheet and a sheet transported immediately after the pertinent sheet for determining whether or not the pertinent sheet and the succeeding sheet are to be sorted to an identical one of the sort transporting means, sets gaps with which the gate means can sort the sheet to target gaps when the sheet and the preceding sheet are sorted to different ones of sort transporting means, and thereby adjusts gaps before and after the pertinent sheet, when a gap obtained by adding a target gap for the preceding sheet and a target gap for the succeeding sheet is less than a gap obtained by adding the gaps before and after the sheet, to values satisfying the target gaps, respectively.

13. A paper sorting apparatus in accordance with claim 8, wherein the control means makes, when sorting a sheet, a comparison, when a gap adjustment is required between the pertinent sheet and a sheet transported immediately before the sheet, between the sheet and a sheet transported immediately after the pertinent sheet for determining whether or not the pertinent sheet and the succeeding sheet are to be sorted to an identical one of the sort transporting means, sets gaps with which the gate means can sort the sheet to target gaps for the pertinent sheet and the preceding sheet when the sheet and the preceding sheet are sorted to different ones of sort transporting means, adjusts, when a gap obtained by adding a target gap for the preceding sheet and a target gap for the succeeding sheet is more than a gap obtained by adding the gaps before and after the sheet, the gap between the preceding sheet and the pertinent sheet if the target gap for the preceding sheet can be ensured, and elongates, when a gap obtained by adding a target gap for the preceding sheet and a target gap for the succeeding sheet is more than a gap obtained by adding the gaps before and after the sheet, the gap between the preceding sheet and the pertinent sheet to a value not causing collision between the pertinent sheet and the succeeding sheet even if the target gap cannot be ensured.

14. A paper sorting apparatus in accordance with claim 8, wherein the control means makes, when sorting a sheet, a comparison, when a gap adjustment is required between the pertinent sheet and a sheet transported immediately before the sheet, between the sheet and a sheet transported immediately after the pertinent sheet for determining whether or not the pertinent sheet and the succeeding sheet are to be sorted to an identical one of the sort transporting means, sets as target gaps, when the pertinent sheet and the succeeding sheet are to be sorted to an identical one of the sort transporting means, gaps obtained in accordance with a sheet gap variation characteristic on a downstream side of the adjusting means and in accordance with a sheet gap variation between the pertinent sheet and the succeeding sheet taking place between the first and second gap measuring means, and adjusts the gaps before and after the pertinent sheet to values satisfying the target gaps when a gap obtained by adding a target gap for the preceding sheet and a target gap for the succeeding sheet is less than a gap obtained by adding the gaps before and after the sheet.

15. A paper sorting apparatus in accordance with claim 8, wherein the control means makes, when sorting a sheet, a comparison, when a gap adjustment is required between the pertinent sheet and a sheet transported immediately before the sheet, between the sheet and a sheet transported immediately after the pertinent sheet for determining whether or not the pertinent sheet and the preceding sheet are to be sorted to an identical one of the sort transporting means, sets as target gaps, when the pertinent sheet and the preceding sheet are to be sorted to an identical one of the sort transporting means, the gaps obtained in accordance with a sheet gap variation characteristic on a downstream side of the adjusting means and in accordance with a sheet gap variation between the pertinent sheet and the succeeding sheet taking place between the first and second gap measuring means, adjusts, when a gap obtained by adding a target gap for the preceding sheet and a target gap for the succeeding sheet is more than a gap obtained by adding the gaps before and after the sheet, the gap between the preceding sheet and the pertinent sheet if the target gap for the preceding sheet can be ensured, and elongates, when a gap obtained by adding a target gap for the preceding sheet and a target gap for the succeeding sheet is more than a gap obtained by adding the gaps before and after the sheet, the gap between the preceding sheet and the pertinent sheet to a gap not causing collision between the pertinent sheet and the succeeding sheet even if the target gap cannot be ensured.

16. A paper sorting apparatus in accordance with claim 8, wherein an appropriate gap between sheets successively transported for distribution thereof to different ones of the sort transporting means is less than an appropriate gap therebetween for distribution thereof to an identical one of the sort transporting means.

17. A paper sorting apparatus in accordance with claim 8, further including:

thickness measuring means disposed at an intermediate point of the transporting means for measuring thickness of a sheet transported by the transporting means; and a threshold value G for determining possibility or impossibility of the opening and closing of the gate, the threshold value G being changed in accordance with thickness of a sheet preceding the pertinent sheet.

18. A paper sorting apparatus in accordance with claim 2, wherein the gap adjusting means includes:

a roller disposed to be brought into contact with a transporting path of sheets transported by the transporting means;

a pinch roller disposed to be brought into contact with and to be releasable from the roller with the transporting path therebetween; and variable-speed driving means for driving a rotary movement of the rollers.

19. A paper sorting apparatus in accordance with claim 2, wherein the gap adjusting means includes:

a roller disposed to be brought into contact with a transporting path of sheets transported by the transporting means;

variable-speed driving means for driving a rotary movement of the roller;

a belt conveyer disposed to be brought into contact with the roller with the transporting path therebetween; and variable-speed driving means for driving the belt conveyer.

20. A paper sorting apparatus in accordance with claim 2, wherein the gap adjusting means includes a plurality of series-connected sets of components along a direction of transportation, each set of components including:

a roller disposed to be brought into contact with a transporting path of sheets transported by the transporting means;

variable-speed driving means for driving a rotary movement of the roller;

a belt conveyer disposed to be brought into contact with the roller with the transporting path therebetween; and variable-speed driving means for driving the belt conveyer.

21. A paper sorting apparatus in accordance with claim 2, wherein the gap adjusting means includes:

a roller disposed to be brought into contact with a transporting path of sheets transported by the transporting means, the roller having a high coefficient of friction with respect to a sheet of paper;

variable-speed driving means for driving a rotary movement of the roller;

a belt conveyer disposed to be brought into contact with the roller with the transporting path therebetween, the belt conveyer having a low coefficient of friction with respect to the sheet of paper; and driving means for driving the belt conveyer at the fixed speed.

22. A paper sorting apparatus in accordance with claim 2, wherein the gap adjusting means includes distance changing means for changing a transporting distance from an exit on an upstream side of the transporting means to an entrance on a downstream side thereof.

23. A paper sorting apparatus in accordance with claim 22, wherein the distance changing means includes a plate-shaped gate member capable of conducting a swinging movement, the distance changing means changing by the swinging of the gate member a transporting distance from an exit on an upstream side of the transporting means to an entrance on a downstream side thereof.

24. A paper sorting apparatus in accordance with claim 22, wherein the distance changing means includes a swing arm having an end capable of conducting a swinging movement in a reciprocal manner to approach and to apart from an entrance on a downstream of the transporting means;

a roller rotatably supported onto an end of the swing art; and a belt conveyer on an upstream side of the transporting means, the belt conveyer being installed on the roller for a rotary action of the roller.

* * * * *